US010972853B2

(12) United States Patent
Kim et al.

(10) Patent No.: US 10,972,853 B2
(45) Date of Patent: Apr. 6, 2021

(54) SIGNALLING BEAM PATTERN WITH OBJECTS

(71) Applicant: QUALCOMM Incorporated, San Diego, CA (US)

(72) Inventors: Moo Young Kim, San Diego, CA (US); Nils Günther Peters, San Diego, CA (US); S M Akramus Salehin, San Diego, CA (US); Dipanjan Sen, Dublin, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/719,392

(22) Filed: Dec. 18, 2019

(65) Prior Publication Data

US 2020/0204939 A1 Jun. 25, 2020

Related U.S. Application Data

(60) Provisional application No. 62/784,239, filed on Dec. 21, 2018.

(51) Int. Cl.

| | |
|---|---|
| ***H04S 7/00*** | (2006.01) |
| ***G10L 19/008*** | (2013.01) |
| ***H04R 5/02*** | (2006.01) |
| ***H04S 3/00*** | (2006.01) |
| ***H04R 5/04*** | (2006.01) |
| ***H04R 3/12*** | (2006.01) |

(52) U.S. Cl.

CPC ..... *H04S 7/302* (2013.01); *G10L 19/008* (2013.01); *H04R 5/02* (2013.01); *H04R 5/04* (2013.01); *H04S 3/008* (2013.01); *H04S 2400/01* (2013.01); *H04S 2400/11* (2013.01)

(58) Field of Classification Search

None

See application file for complete search history.

(56) References Cited

U.S. PATENT DOCUMENTS

| | | | | |
|---|---|---|---|---|
| 9,774,976 | B1 * | 9/2017 | Baumgarte | H04S 7/305 |
| 2009/0087000 | A1 * | 4/2009 | Ko | H04S 7/302 381/182 |
| 2011/0249821 | A1 | 10/2011 | Jaillet et al. | |
| 2014/0025386 | A1 * | 1/2014 | Xiang | G10L 19/008 704/500 |
| 2017/0347218 | A1 * | 11/2017 | Jeon | H04S 3/008 |
| 2018/0091919 | A1 * | 3/2018 | Chon | H04S 7/303 |
| 2018/0242077 | A1 * | 8/2018 | Smithers | H04R 3/04 |
| 2019/0069083 | A1 * | 2/2019 | Salehin | H04R 3/005 |

(Continued)

OTHER PUBLICATIONS

"Call for Proposals for 3D Audio," ISO/IEC JTC1/SC29/WG11/N13411, Jan. 2013, 20 pp.

(Continued)

*Primary Examiner* — Qin Zhu

(74) *Attorney, Agent, or Firm* — Shumaker & Sieffert, P.A.

(57) ABSTRACT

A device for processing coded audio is disclosed. The device is configured to store an audio object and audio object metadata associated with the audio object. The audio object metadata includes frequency dependent beam pattern metadata. The device may apply, based on the frequency dependent beam pattern metadata, a renderer to the audio object to obtain one or more speaker feeds and output the one or more speaker feeds.

30 Claims, 14 Drawing Sheets

(56) References Cited

U.S. PATENT DOCUMENTS

2019/0215632 A1* 7/2019 Chung ..... H04S 1/007
2019/0253821 A1* 8/2019 Buchner ..... H04S 7/30

OTHER PUBLICATIONS

Herre J., et al., "MPEG-H 3D Audio—The New Standard for Coding of Immersive Spatial Audio," IEEE Journal of Selected Topics in Signal Processing, Aug. 1, 2015 (Aug. 1, 2015), vol. 9(5), pp. 770-779, XP055243182, US ISSN: 1932-4553, DOI: 10.1109/JSTSP.2015.2411578.

Hollerweger F., "An Introduction to Higher Order Ambisonic," Oct. 2008, pp. 13, Accessed online [Jul. 8, 2013].

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, ISO/IEC 23008-3:2015/PDAM 3, Jul. 25, 2015, 208 pp.

ISO/IEC/JTC: "ISO/IEC JTC 1/SC 29 N ISO/IEC CD 23008-3 Information technology—High efficiency coding and media delivery in heterogeneous environments—Part 3: 3D audio," Apr. 4, 2014 (Apr. 4, 2014), 337 Pages, XP055206371, Retrieved from the Internet: URL:http://www.iso.org/iso/iso_catalogue/catalogue_tc/catalogue_tc_browse.htm?commid=45316 [retrieved on Aug. 5, 2015].

ITU-R BS.2076-1, Recommendation ITU-R BS.2076-1, Audio Definition Model, BS Series Broadcasting service (sound), Jun. 2017, 106 pages.

Peterson J., et al., "Virtual Reality, Augmented Reality, and Mixed Reality Definitions," EMA, version 1.0, Jul. 7, 2017, 4 pp.

Schonefeld V., "Spherical Harmonics," Jul. 1, 2005, XP002599101, 25 Pages, Accessed online [Jul. 9, 2013] at URL:http://heim.c-otto.de/~volker/prosem_paper.pdf.

Sen D., et al., "RM1-HOA Working Draft Text", 107. MPEG Meeting; Jan. 13, 2014-Jan. 17, 2014; San Jose; (Motion Picture Expert Group or ISO/IEC JTC1/SC29/WG11), No. M31827, Jan. 11, 2014 (Jan. 11, 2014), 83 Pages, XP030060280.

Sen D., et al., "Technical Description of the Qualcomm's HoA Coding Technology for Phase II", 109. MPEG Meeting; Jul. 7, 2014-Nov. 7, 2014; Sapporo, JP; (Motion Picture Expert Group or ISO/IEC JTC1/SC29/WG11), No. m34104, Jul. 2, 2014 (Jul. 2, 2014), 4 Pages, XP030062477, figure 1.

WG11: "Proposed Draft 1.0 of TR: Technical Report on Architectures for Immersive Media", ISO/IEC JTC1/SC29/WG11/N17685, San Diego, US, Apr. 2018, 14 pages.

* cited by examiner

SIGNALLING BEAM PATTERN WITH OBJECTS

This application claims the benefit of U.S. Provisional Application No. 62/784,239 filed Dec. 21, 2018, the entire content of which is hereby incorporated by reference.

TECHNICAL FIELD

This disclosure relates to processing of media data, such as audio data.

BACKGROUND

The evolution of surround sound has made available many output formats for entertainment. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

SUMMARY

This disclosure describes techniques for new object metadata to represent more precise beam patterns using object-based audio.

According to one example, a device configured for processing coded audio includes a memory configured to store an audio object and audio object metadata associated with the audio object, wherein the audio object meta data comprises frequency dependent beam pattern metadata, and one or more processors electronically coupled to the memory, the one or more processors configured to apply, based on the frequency dependent beam pattern metadata, a renderer to the audio object to obtain one or more first speaker feeds and output the one or more speaker feeds.

According to another example, a method for processing coded audio includes storing an audio object and audio object metadata associated with the audio object, wherein the audio object meta data comprises frequency dependent beam pattern metadata; applying, based on the frequency dependent beam pattern metadata, a renderer to the audio object to obtain one or more first speaker feeds; and outputting the one or more speaker feeds.

According to another example, a computer-readable storage medium stores instructions that when executed by one or more processors cause the one or more processors to store an audio object and audio object metadata associated with the audio object, wherein the audio object meta data comprises frequency dependent beam pattern metadata; apply, based on the frequency dependent beam pattern metadata, a renderer to the audio object to obtain one or more first speaker feeds; and output the one or more speaker feeds.

According to another example, an apparatus for processing coded audio includes means for storing an audio object and audio object metadata associated with the audio object, wherein the audio object meta data comprises frequency dependent beam pattern metadata; means for applying, based on the frequency dependent beam pattern metadata, a renderer to the audio object to obtain one or more first speaker feeds; and output the one or more speaker feeds.

The details of one or more examples of the disclosure are set forth in the accompanying drawings and the description below. Other features, objects, and advantages will be apparent from the description, drawings, and claims.

DETAILED DESCRIPTION

Figure 1:
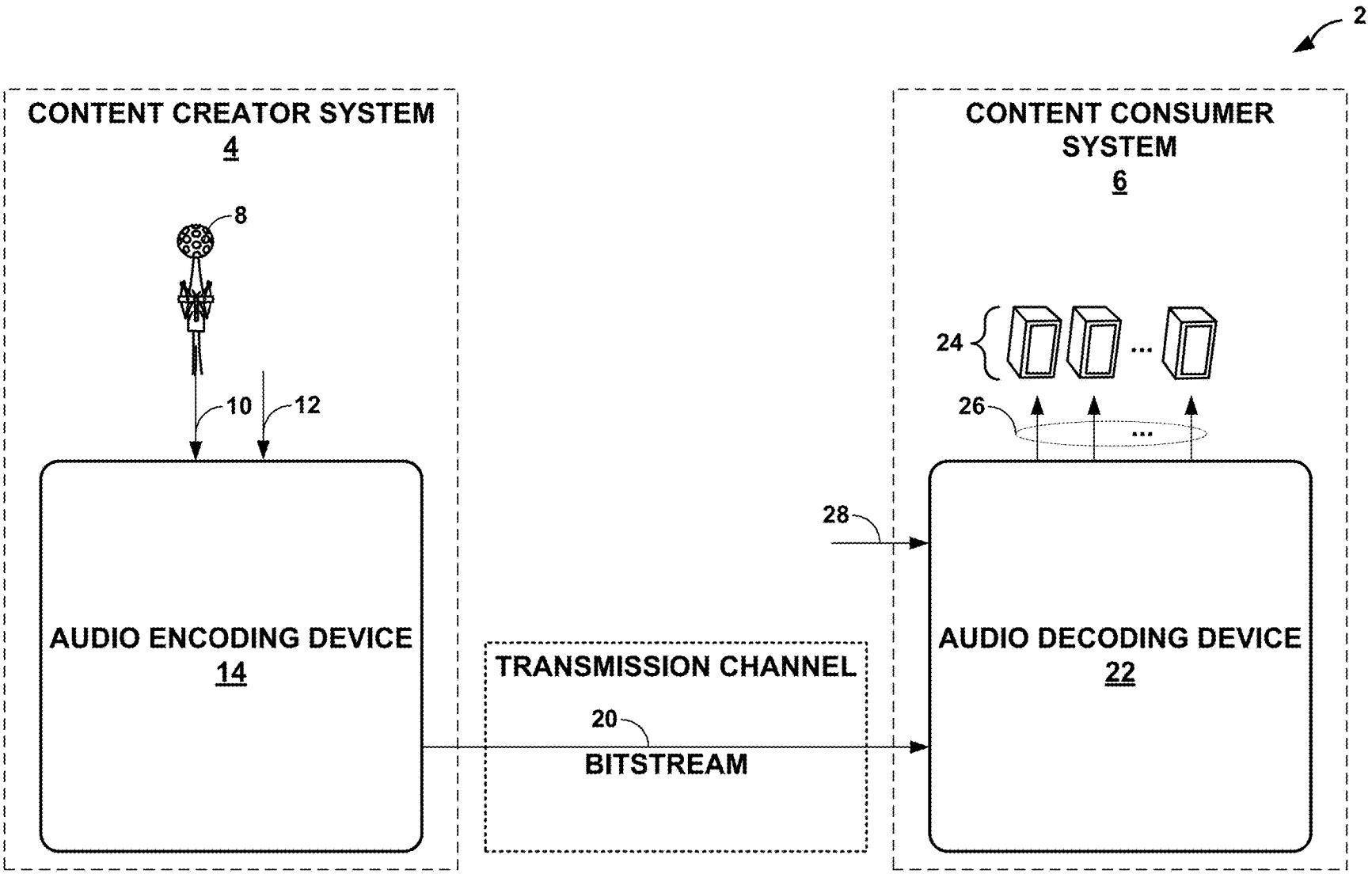
FIG. 1 is a diagram illustrating a system that may perform various aspects of the techniques described in this disclosure.

Audio encoders may receive input in one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients").

This disclosure describes techniques for new object metadata to represent more precise beam patterns using object-based audio. More specifically, a common set of metadata for object-based audio data includes azimuth, elevation, distance, gain, and diffuseness, and this disclosure introduces weighting values that may enable the rendering of more precise beam patterns. Each beam pattern (whether frequency dependent or not) may use a set of weighting values and a set of metadata. For example, if N=3, 3 weighting values and 3 sets of {azimuth, elevation, distance, gain, and diffuseness} metadata can be used to generate a beam pattern B. This B can be used to locate an audio object.

3D Audio has three audio elements, typically referred to as channel-, object-, and scene-based audio. The object-based audio is described with audio and associated metadata. A common set of metadata includes azimuth, elevation, distance, gain, and diffuseness. This disclosure introduces new object metadata to describe more precise beam patterns. More specifically, according to one example, the proposed object audio metadata includes weighting values, in addition to set(s) of azimuth, elevation, distance, gain, and diffuseness, with the weighting values enabling a content consumer device to model complex beam patterns (as shown in the examples of FIGS. 10A-10C).

According to one example of the techniques of this disclosure, for a given object audio signal, a content consumer device can model a beam pattern with a weighted summation of multiple single-directional beams, according to equation (1A):

$$\hat{B}=\Sigma_{i=}{}^{N}\omega_i B(\theta_i,\varphi_i) \tag{1A}$$

Equation 1A can be used for each frequency band. If there are two bands, for example, then 2×N weighting values and 2×N set of {azimuth, elevation, distance, gain, and diffuseness} metadata may be. An audio object may be bandpass filtered into A_1st_band and A_2nd_band. A_1st_band is rendered with the first set of weighting values and the first set of metadata. A_2_nd_band is rendered with the second set of weighting values and the second set of metadata. The final output is the sum of the two renderings.

Thus, equation 1A can be extended to multiple audio objects to describe a single audio scene, using equation (1B).

$$B^k{}_m=\Sigma_{i=1}{}^{N}\omega^k{}_{m,i}B(\Lambda^k{}_{m,i}) \tag{1B}$$

where for i:1 to N, N corresponds to the number of weightings and metadata sets, for m: 1 to M, M corresponds to the number of frequency bands, and for K: 1 to K, K corresponds to the number of audio objects The content consumer device can perform rendering, using for example VBAP (described in more detail below). The content consumer device can receive an input audio S, N-number of weightings, and N-number of sets of metadata, with each setting including some or all of azimuth, elevation, distance, gain, and diffuseness. For i=1:N, the content consumer devices can obtain weighted audio according to equation (2) below:

$$WS_i=w_i S \tag{2}$$

The content consumer device can render $WS_i$ using VBAP using an i-th set of azimuth, elevation, distance, gain, diffuseness. The content consumer device may also render $WS_i$ using another object renderer, such as SPH or a beam pattern codebook. The content consumer device can provide speaker feeds LSin(i,j) where j is the speaker index, by calculating the j-th speaker contribution according to equation (3):

$$LS\text{out}(j)=\Sigma_{i=1}{}^{N}LS\text{in}(i,j) \tag{3}$$

In some implementations, in order to reduce complexity, the weighted audio ($WS_i$) may be obtained by calculating the contributions of each loudspeaker. As the same audio source S may be panned with N metadata, for each speaker, the contributions from N metadata can be summed into a single contribution value, $l_i$. For each speaker, the content consumer device can use $l_i S$ as a speaker feed.

According to other aspects of this disclosure, a content consumer device may be configured to change a beam pattern with frequency, using, for example, a flag in the metadata. The content consumer device may, for example, make the beam pattern become more directive at higher frequencies. The beam pattern can, for instance, be specified at frequencies or ERB/Bark/Gammatone scale frequency division.

In one example, frequency dependent beam pattern metadata may include a Freq_dep_beampattern syntax element, where a value of 0 indicates the beam pattern is the same at all frequencies, and a value of 1 indicates the beam pattern changes with frequency. The metadata may also include a Freq_scale syntax element, where one value of the syntax element indicates normal, another value of the syntax element indicates bark, another value of the syntax element indicates ERB, and another value of the syntax element indicates Gammatone. In one example, frequencies between 0-100 Hz may use one type of beam pattern, determined by a codebook or spherical harmonic coefficients, for example, while 12 Khz to 20 Khz uses a different beam pattern. Other frequency ranges may also use different beam patterns.

FIG. 1 is a diagram illustrating a system 2 that may perform various aspects of the techniques described in this disclosure. As shown in the example of FIG. 1, the system 2 includes content creator system 4 and content consumer system 6. While described in the context of the content creator system 4 and the content consumer system 6, the techniques may be implemented in any context in which audio data is encoded to form a bitstream representative of the audio data. Moreover, content creator system 4 may include any form of computing device, or computing devices, capable of implementing the techniques described in this disclosure, including a handset (or cellular phone), a tablet computer, a smart phone, or a desktop computer to provide a few examples. Likewise, the content consumer system 6 may include any form of computing device, or computing devices, capable of implementing the techniques described in this disclosure, including a handset (or cellular phone), a tablet computer, a smart phone, a set-top box, an AV-receiver, a wireless speaker, or a desktop computer to provide a few examples. The content consumer system 6 may also take other forms such as a vehicle (either manned or unmanned) or a robot.

The content creator system 4 may be operated by various content creators, such as movie studios, television studios, internet streaming services, or other entity that may generate audio content for consumption by operators of content consumer systems, such as the content consumer system 6. Often, the content creator generates audio content in conjunction with video content. The content consumer system 6 may be operated by an individual. In general, the content consumer system 6 may refer to any form of audio playback system capable of outputting multi-channel audio content.

The content creator system 4 includes audio encoding device 14, which may be capable of encoding received audio data into a bitstream. The audio encoding device 14 may receive the audio data from various sources. For instance, the audio encoding device 14 may obtain live audio data 10 and/or pre-generated audio data 12. The audio encoding device 14 may receive the live audio data 10 and/or the pre-generated audio data 12 in various formats. As one example, audio encoding device 14 includes one or more microphones 8 configured to capture one or more audio signals. For instance, the audio encoding device 14 may receive the live audio data 10 from one or more microphones 8 as audio objects. As another example, the audio encoding device 14 may receive the pre-generated audio data 12 as audio objects.

As stated above, the audio encoding device 14 may encode the received audio data into a bitstream, such as bitstream 20, for transmission, as one example, across a transmission channel, which may be a wired or wireless channel, a data storage device, or the like. In some examples, the content creator system 4 directly transmits the encoded bitstream 20 to content consumer system 6. In other examples, the encoded bitstream may also be stored onto a storage medium or a file server for later access by the content consumer system 6 for decoding and/or playback.

Content consumer system 6 may generate loudspeaker feeds 26 based on bitstream 20. As shown in FIG. 1, the content consumer system 6 may include audio decoding device 22 and loudspeakers 24. The audio decoding device 22 may be capable of decoding the bitstream 20.

The audio encoding device 14 and the audio decoding device 22 each may be implemented as any of a variety of suitable circuitry, such as one or more integrated circuits including microprocessors, digital signal processors (DSPs), application specific integrated circuits (ASICs), field programmable gate arrays (FPGAs), discrete logic, software, hardware, firmware, or any combinations thereof. When the techniques are implemented partially in software, a device may store instructions for the software in a suitable, non-transitory computer-readable medium and execute the instructions in hardware such as integrated circuitry using one or more processors to perform the techniques of this disclosure.

Figure 2:
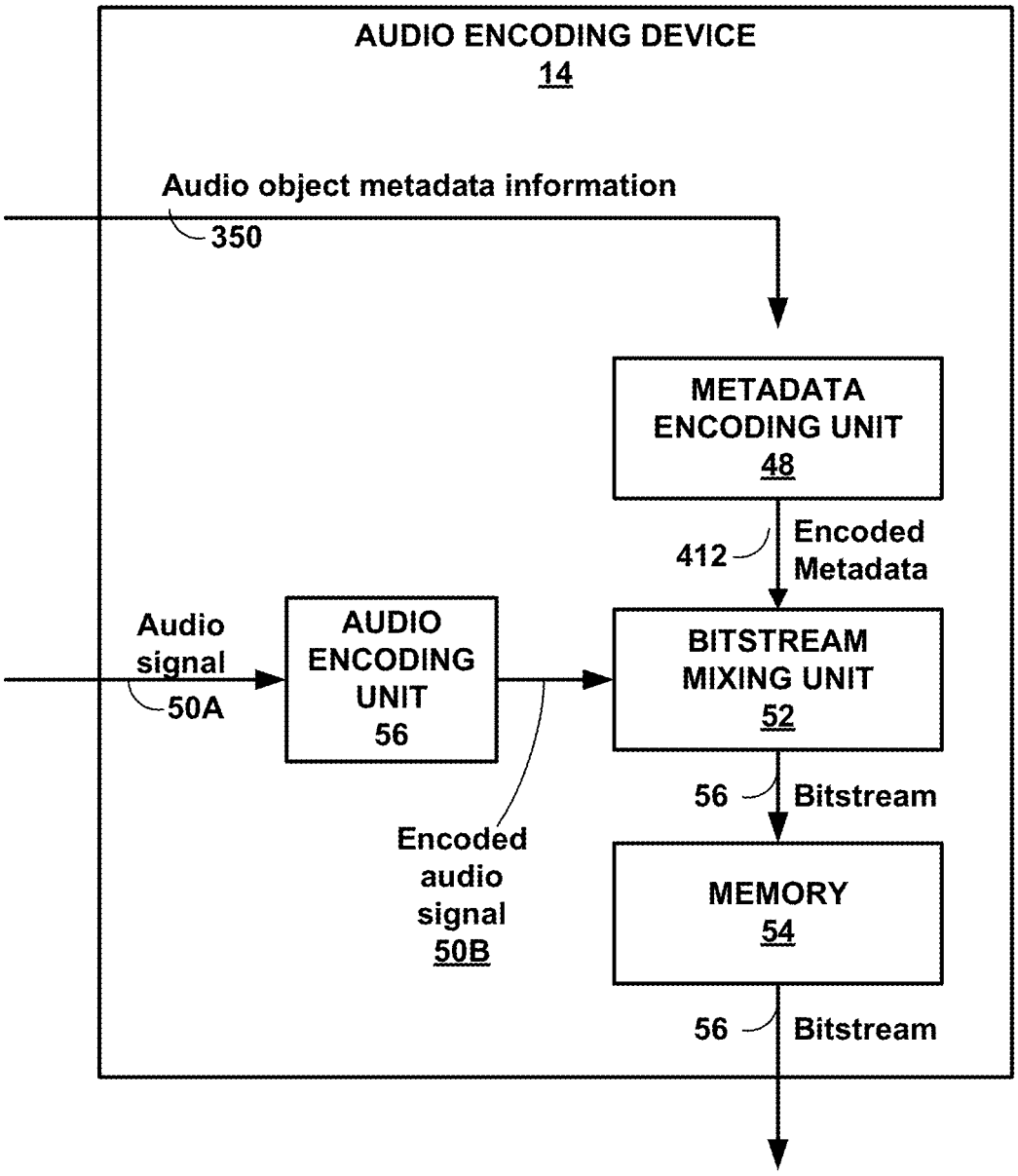
FIG. 2 is a block diagram illustrating an example implementation of an audio encoding device in which the audio encoding device is configured to encode object-based audio data, in accordance with one or more techniques of this disclosure.

FIG. 2 is a block diagram illustrating an example implementation of the audio encoding device 14 in which the audio encoding device 14 is configured to encode object-based audio data, in accordance with one or more techniques of this disclosure. In the example of FIG. 2, the audio encoding device 14 includes a metadata encoding unit 48, a bitstream mixing unit 52, and a memory 54, and audio encoding unit 56.

In the example of FIG. 2, the metadata encoding unit 48 obtains and encodes audio object metadata information 350. The audio object metadata information 350 includes, for example, frequency dependent beam pattern metadata as described in this disclosure. The audio object metadata may, for example, include M sets of weighting values and at least M sets of metadata representative of M directional beams, each of the M directional beams corresponding to one of the M frequency bands. Each of the M sets of metadata representative of M directional beams may, for example, include one or more of an azimuth value, an elevation value, a distance value, and a gain value. Other types of metadata such as metadata representative of room model information, occlusion information, etc. may also be included in the audio object metadata.

Figure 3:
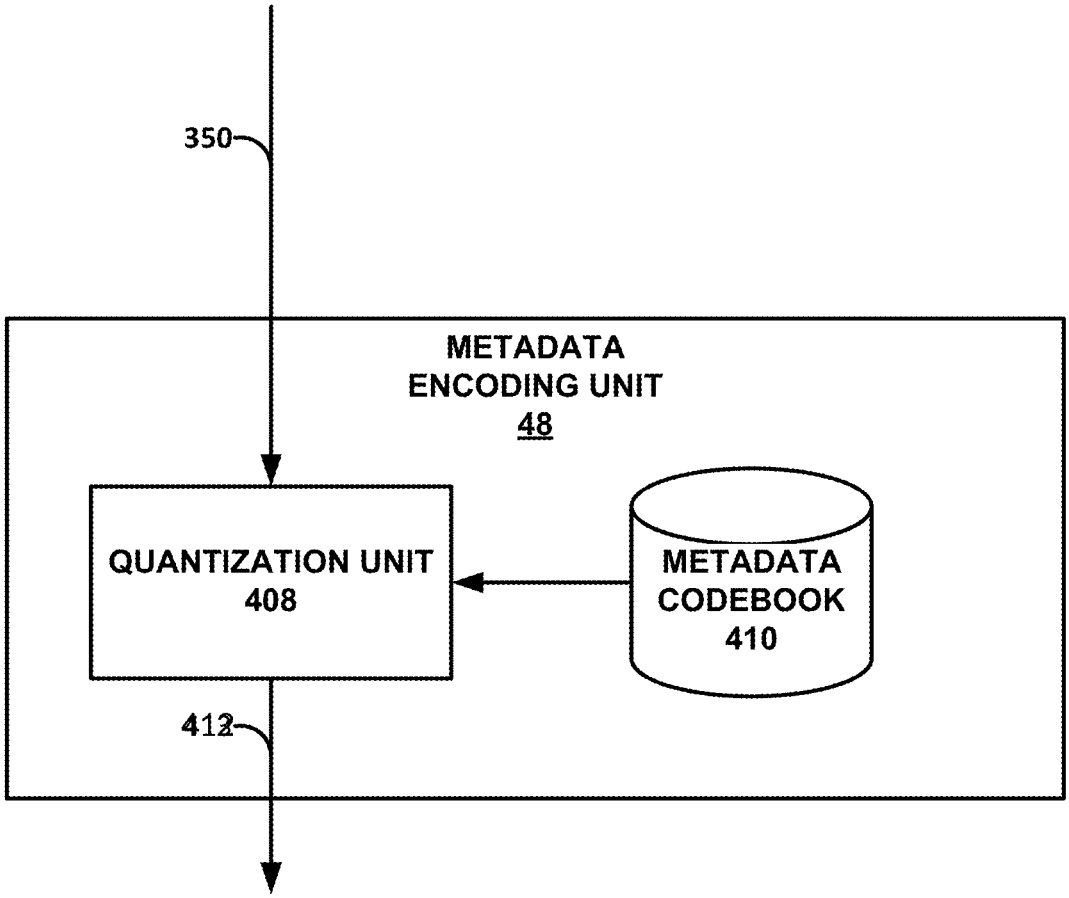
FIG. 3 is a block diagram illustrating an example implementation of a metadata encoding unit for object-based audio data.

The metadata encoding unit 48 determines encoded metadata 412 for the audio object based on the obtained audio object metadata information. FIG. 3, described in detail below, describes an example implementation of the metadata encoding unit 48.

The audio encoding unit 56 encodes audio signal 50A to generate encoded audio signal 50B. In some examples, the audio encoding unit 56 may encode audio signal 50A using a known audio compression format, such as MP3, AAC, Vorbis, FLAC, and Opus. In some instances, the audio encoding unit 56 may transcode the audio signal 50A from one compression format to another. In some examples, the audio encoding device 14 may include an audio encoding unit to compress and/or transcode audio signal 50A.

Bitstream mixing unit 52 mixes the encoded audio signal 50B with the encoded metadata to generate bitstream 56. In the example of FIG. 2, memory 54 stores at least portions of the bitstream 56 prior to output by the audio encoding device 14.

Thus, the audio encoding device 14 includes a memory configured to store an audio signal of an audio object (e.g., audio signals 50A and 50B and bitstream 56) for a time interval and store metadata (e.g., audio object metadata information 350). Furthermore, the audio encoding device 14 includes one or more processors electrically coupled to the memory.

FIG. 3 is a block diagram illustrating an example implementation of the metadata encoding unit 48 for object-based audio data, in accordance with one or more techniques of this disclosure. In the example of FIG. 3, the metadata encoding unit 48 includes a quantization unit 408 and a metadata codebook 410. Metadata encoding unit 48 receives audio object metadata information 350 and outputs encoded metadata 412.

Figure 4:
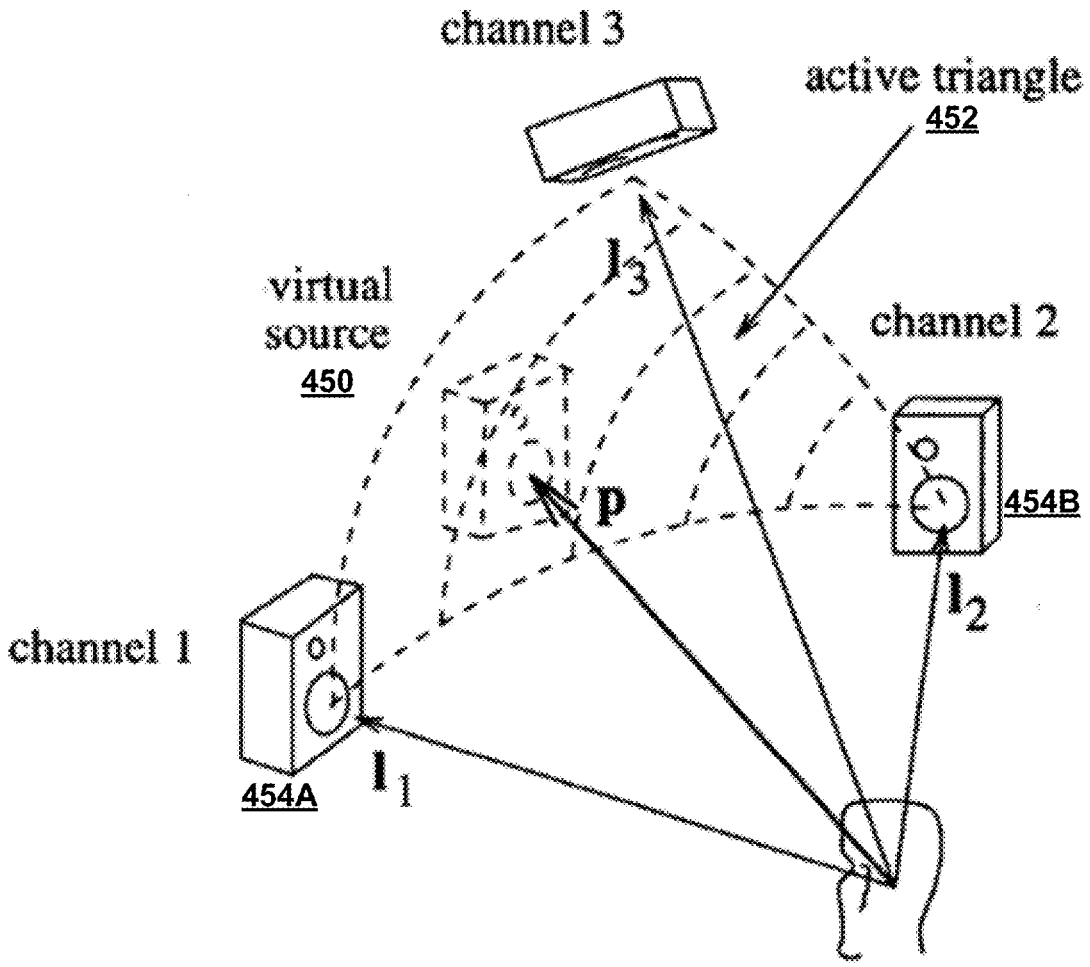
FIG. 4 is a conceptual diagram illustrating vector-based amplitude panning (VBAP).

FIG. 4 is a conceptual diagram illustrating VBAP. In VBAP, the gain factors applied to an audio signal output by three speakers trick a listener into perceiving that the audio signal is coming from a virtual source position 450 located within an active triangle 452 between the three loudspeakers. For instance, in the example of FIG. 4, the virtual source position 180 is closer to loudspeaker 454A than to loudspeaker 454B. Accordingly, the gain factor for the loudspeaker 454A may be greater than the gain factor for the loudspeaker 454B. Other examples are possible with greater numbers of loudspeakers or with two loudspeakers.

VBAP uses a geometrical approach to calculate gain factors 416. In examples, such as FIG. 4, where three loudspeakers are used for each audio object, the three loudspeakers are arranged in a triangle to form a vector base. Each vector base is identified by the loudspeaker numbers k, m, n and the loudspeaker position vectors $I_k$, $I_m$, and $I_n$ given in Cartesian coordinates normalized to unity length. The vector base for loudspeakers k, m, and n may be defined by:

$$I_{k,m,n}=(I_k, I_m, I_n) \tag{4}$$

The desired direction Q=(θ, φ) of the audio object may be given as azimuth angle φ and elevation angle θ. The unity length position vector p(Ω) of the virtual source in Cartesian coordinates is therefore defined by:

$$p(\Omega)=(\cos\varphi \sin\theta, \sin\varphi \sin\theta, \cos\theta)^T. \tag{5}$$

A virtual source position can be represented with the vector base and the gain factors $g(\Omega)=g(\Omega)=(\tilde{g}_k, \tilde{g}_m, \tilde{g}_n)^T$ by $$p(\Omega)=L_{kmn}g(\Omega)=\tilde{g}_k I_k+\tilde{g}_m I_m+\tilde{g}_n I_n. \tag{6}$$

By inverting the vector base matrix, the required gain factors can be computed by:

$$g(Q)=L_{kmn}^{-1}p(\Omega). \quad (7)$$

The vector base to be used is determined according to Equation (7). First, the gains are calculated according to Equation (7) for all vector bases. Subsequently, for each vector base, the minimum over the gain factors is evaluated by $g(\Omega)=\min\{\tilde{g}_k, \tilde{g}_m, \tilde{g}_n\}$. The vector base where $\tilde{g}_{min}$ has the highest value is used. In general, the gain factors are not permitted to be negative. Depending on the listening room acoustics, the gain factors may be normalized for energy preservation.

Figure 5:
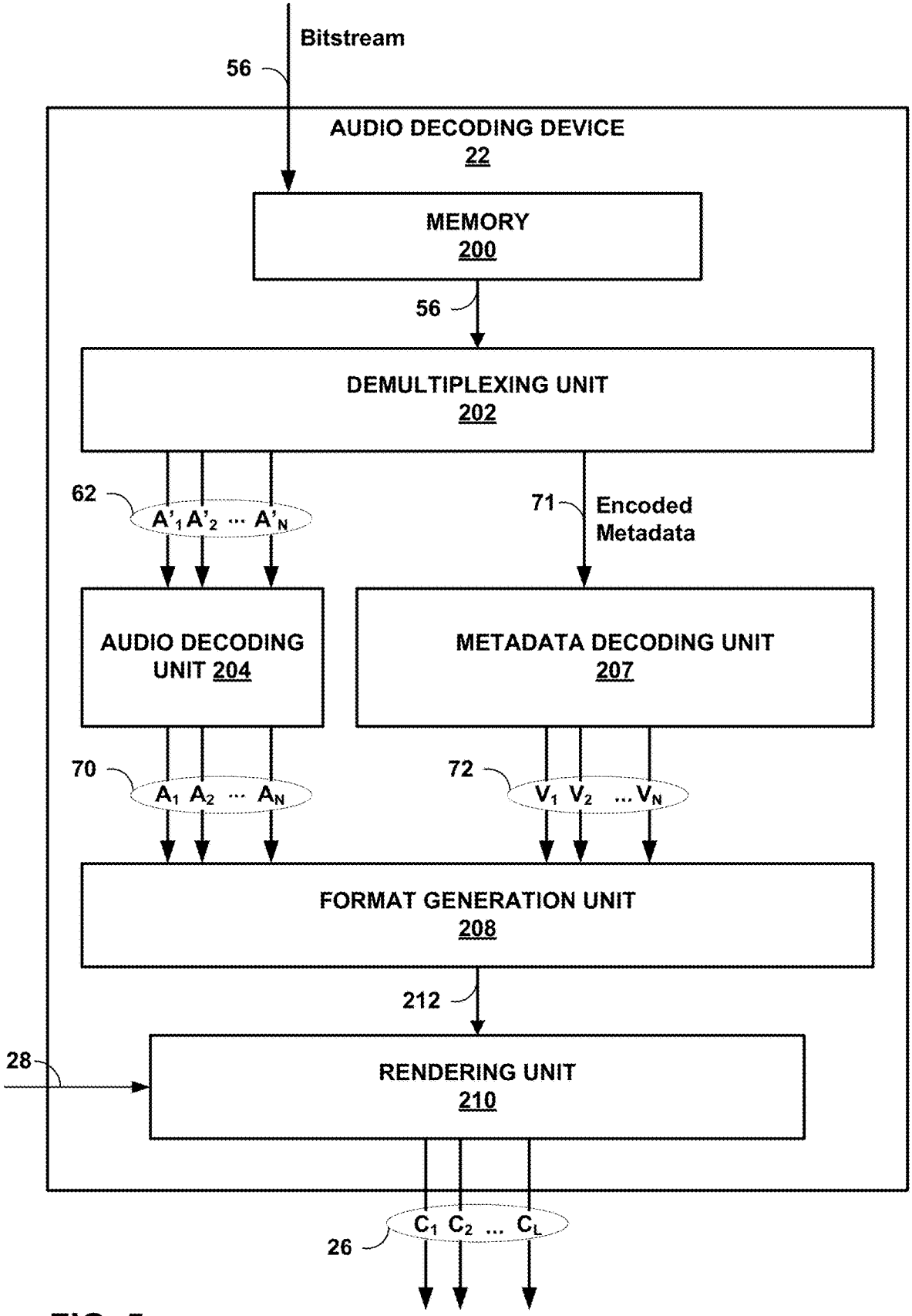
FIG. 5 is a block diagram illustrating an example implementation of an audio decoding device in which the audio decoding device is configured to decode object-based audio data, in accordance with one or more techniques of this disclosure.

FIG. 5 is a block diagram illustrating an example implementation of audio decoding device 22 in which the audio decoding device 22 is configured to decode object-based audio data, in accordance with one or more techniques of this disclosure. In the example of FIG. 5, the audio decoding device 22 includes memory 200, demultiplexing unit 202, audio decoding unit 204, metadata decoding unit 207, format generation unit 208, and rendering unit 210. In some examples, the implementation of the audio decoding device 22 described with regard to FIG. 5 may include more, fewer, or different units. For instance, the rendering unit 210 may be implemented in a separate device, such as a loudspeaker, headphone unit, or audio base or satellite device.

The memory 200 may obtain encoded audio data, such as the bitstream 56. In some examples, the memory 200 may directly receive the encoded audio data (i.e., the bitstream 56) from an audio encoding device. In other examples, the encoded audio data may be stored, and the memory 200 may obtain the encoded audio data (i.e., the bitstream 56) from a storage medium or a file server. The memory 200 may provide access to the bitstream 56 to one or more components of the audio decoding device 22, such as the demultiplexing unit 202.

The demultiplexing unit 202 may obtain encoded metadata 71 and audio signal 62 from the bitstream 56. The encoded metadata 71 includes, for example, the frequency dependent beam pattern metadata described above. Thus, the demultiplexing unit 202 may obtain, from the bitstream 56, data representing an audio signal of an audio object and may obtain, from the bitstream 56, metadata for rendering M frequency bands using M different beam patterns in response to the number of frequency bands being equal to M.

The audio decoding unit 204 may be configured to decode the coded audio signal 62 into audio signal 70. For instance, the audio decoding unit 204 may dequantize, deformat, or otherwise decompress audio signal 62 to generate the audio signal 70. In some examples, the audio decoding unit 204 may be referred to as an audio CODEC. The audio decoding unit 204 may provide the decoded audio signal 70 to one or more components of the audio decoding device 22, such as format generation unit 208.

The metadata decoding unit 207 may decode the encoded metadata 71 to determine the frequency dependent beam pattern metadata described above.

The format generation unit 208 may be configured to generate a soundfield, in a specified format, based on multi-channel audio data and the frequency dependent beam pattern metadata described above. For instance, the format generation unit 208 may generate renderer input 212 based on the decoded audio signal 70 and the decoded metadata 72. The renderer input 212 may, for example, include a set of audio objects and decoded metadata.

The format generation unit 208 may provide the generated the renderer input 212 to one or more other components. For instance, as shown in the example of FIG. 5, the format generation unit 208 may provide the renderer input 212 to the rendering unit 210.

The rendering unit 210 may be configured to render a soundfield. In some examples, the rendering unit 210 may render a renderer input 212 to generate audio signals 26 for playback at a plurality of local loudspeakers, such as the loudspeakers 24 of FIG. 1. Where the plurality of local loudspeakers includes L loudspeakers, the audio signals 26 may include channels $C_1$ through $C_L$ that are respectively indented for playback through loudspeakers 1 through L.

The rendering unit 210 may generate the audio signals 26 based on local loudspeaker setup information 28, which may represent positions of the plurality of local loudspeakers. The rendering unit 210 may generate a plurality of audio signals 26 by applying a rendering format (e.g., a local rendering matrix) to the audio objects. Each respective audio signal of the plurality of audio signals 26 may correspond to a respective loudspeaker in a plurality of loudspeakers, such as the loudspeakers 24 of FIG. 1.

In some examples, the local loudspeaker setup information 28 may be in the form of a local rendering format $\tilde{D}$. In some examples, local rendering format $\tilde{D}$ may be a local rendering matrix. In some examples, such as where the local loudspeaker setup information 28 is in the form of an azimuth and an elevation of each of the local loudspeakers, the rendering unit 210 may determine local rendering format $\tilde{D}$ based on the local loudspeaker setup information 28. In some examples, the local rendering format $\tilde{D}$ may be different than the source rendering format D used to determine spatial positioning vectors. As one example, positions of the plurality of local loudspeakers may be different than positions of the plurality of source loudspeakers. As another example, a number of loudspeakers in the plurality of local loudspeakers may be different than a number of loudspeakers in the plurality of source loudspeakers. As another example, both the positions of the plurality of local loudspeakers may be different than positions of the plurality of source loudspeakers and the number of loudspeakers in the plurality of local loudspeakers may be different than the number of loudspeakers in the plurality of source loudspeakers.

In some examples, the rendering unit 210 may adapt the local rendering format based on information 28 indicating locations of a local loudspeaker setup. The rendering unit 210 may adapt the local rendering format in the manner described below with regard to FIG. 8.

Figure 6:
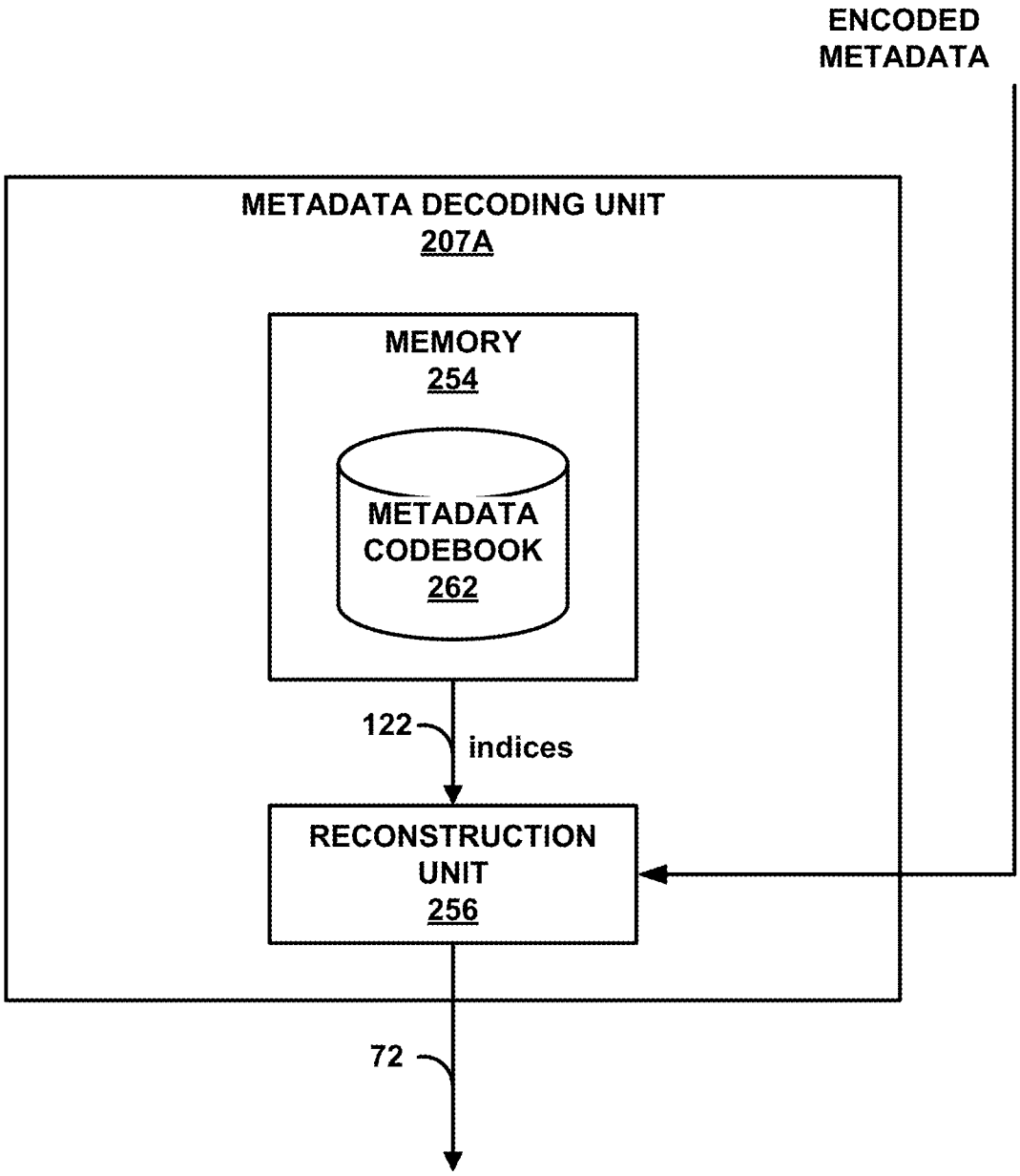
FIG. 6 is a block diagram illustrating an example implementation of a vector decoding unit, in accordance with one or more techniques of this disclosure.

FIG. 6 is a block diagram illustrating an example implementation of metadata decoding unit 207 of FIG. 5, in accordance with one or more techniques of this disclosure. In the example of FIG. 6, the example implementation of the metadata decoding unit 207 is labeled metadata decoding unit 207A. In the example of FIG. 6, the metadata decoding unit 207A includes memory 254 and reconstruction unit 256. The memory 254 stores metadata codebook 262. In other examples, the metadata decoding unit 207 may include more, fewer, or different components.

The memory 254 may store a metadata codebook 262. The memory 254 may be separate from the metadata decoding unit 207A and may form part of a general memory of the audio decoding device 22. The metadata codebook 262 includes a set of entries, each of which maps an index to a value for a metadata entry. The metadata codebook 262 may match a codebook used by the metadata encoding unit 48 of FIG. 3. Reconstruction unit 256 may output decoded metadata 72.

Figure 7:
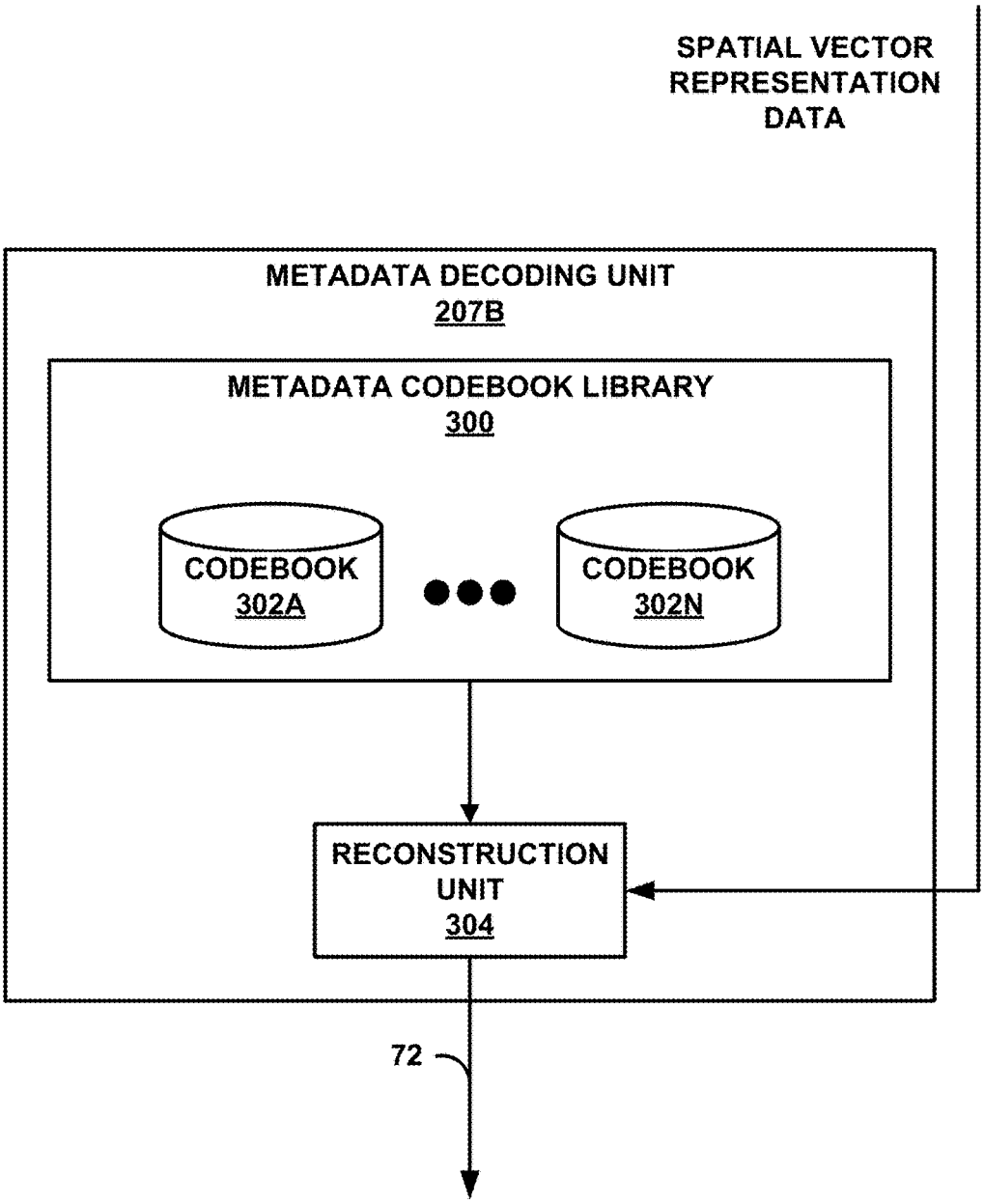
FIG. 7 is a block diagram illustrating an alternative implementation of a vector decoding unit, in accordance with one or more techniques of this disclosure.

FIG. 7 is a block diagram illustrating an example implementation of metadata decoding unit 207 of FIG. 5, in accordance with one or more techniques of this disclosure. The particular implementation of FIG. 7 is shown as metadata decoding unit 207B. The metadata decoding unit 207B includes a metadata codebook library 300 and a reconstruction unit 304. The metadata codebook library 300 may be implemented using a memory. The metadata codebook library 300 includes one or more predefined codebooks 302A-302N (collectively, "codebooks 302"). Each respective one of codebooks 302 includes a set of one or more entries. Each respective entry maps a respective index to a respective metadata value. The metadata codebook library 300 may match a codebook library used by metadata encoding unit 48 of FIG. 3. In the example of FIG. 7, reconstruction unit 304 outputs decoded metadata 72.

Figure 8:
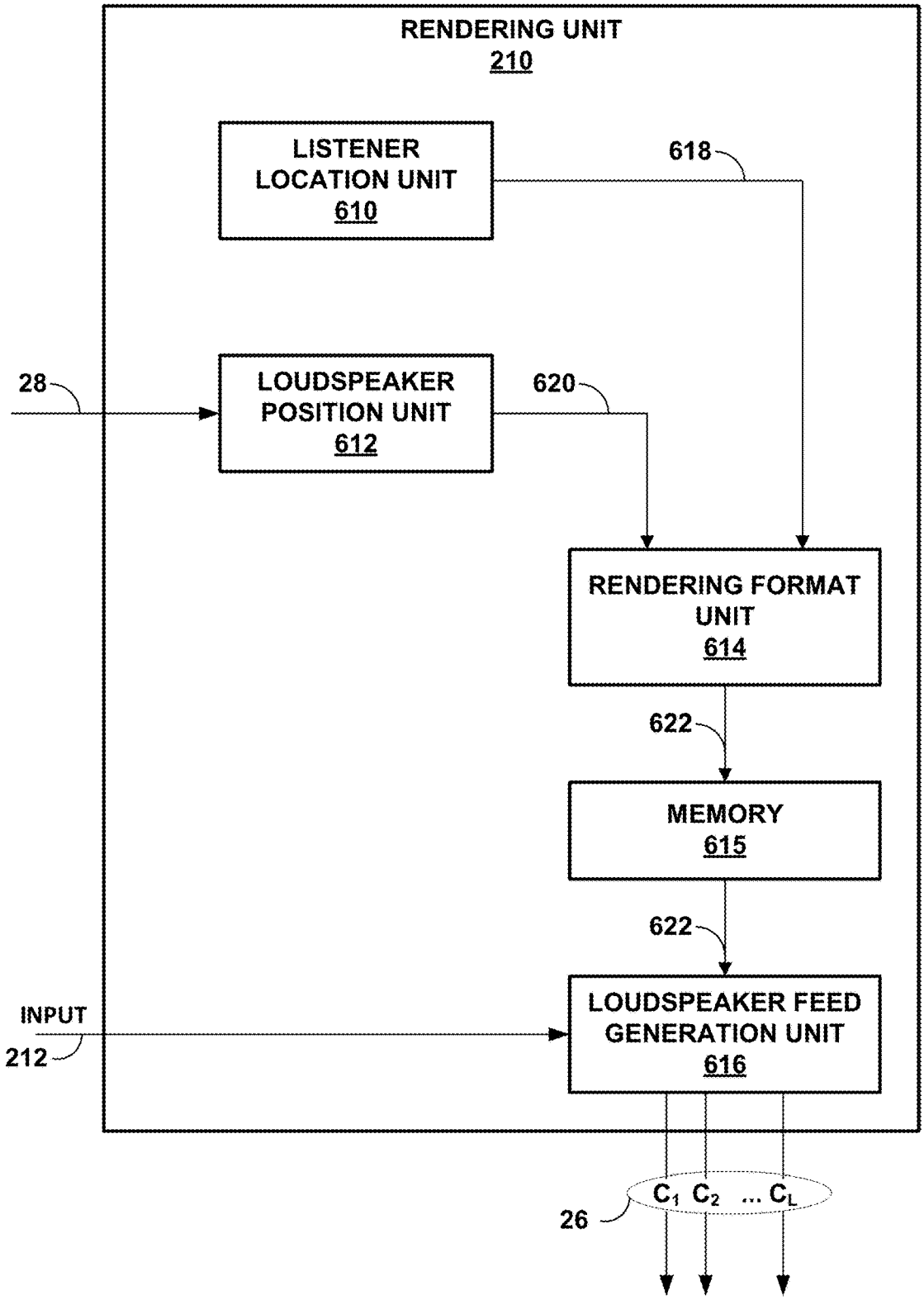
FIG. 8 is a block diagram illustrating an example implementation of a rendering unit, in accordance with one or more techniques of this disclosure.

FIG. 8 is a block diagram illustrating an example implementation of the rendering unit 210 of FIG. 5, in accordance with one or more techniques of this disclosure. As illustrated in FIG. 8, the rendering unit 210 may include listener location unit 610, loudspeaker position unit 612, rendering format unit 614, memory 615, and loudspeaker feed generation unit 616.

The listener location unit 610 may be configured to determine a location of a listener of a plurality of loudspeakers, such as loudspeakers 24 of FIG. 1. In some examples, the listener location unit 610 may determine the location of the listener periodically (e.g., every 1 second, 5 seconds, 10 seconds, 30 seconds, 1 minute, 5 minutes, 10 minutes, etc.). In some examples, the listener location unit 610 may determine the location of the listener based on a signal generated by a device positioned by the listener. Some example of devices which may be used by the listener location unit 610 to determine the location of the listener include, but are not limited to, mobile computing devices, video game controllers, remote controls, or any other device that may indicate a position of a listener. In some examples, the listener location unit 610 may determine the location of the listener based on one or more sensors. Some example of sensors which may be used by the listener location unit 610 to determine the location of the listener include, but are not limited to, cameras, microphones, pressure sensors (e.g., embedded in or attached to furniture, vehicle seats), seatbelt sensors, or any other sensor that may indicate a position of a listener. The listener location unit 610 may provide indication 618 of the position of the listener to one or more other components of the rendering unit 210, such as rendering format unit 614.

The loudspeaker position unit 612 may be configured to obtain a representation of positions of a plurality of local loudspeakers, such as the loudspeakers 24 of FIG. 1. In some examples, the loudspeaker position unit 612 may determine the representation of positions of the plurality of local loudspeakers based on local loudspeaker setup information 28. The loudspeaker position unit 612 may obtain the local loudspeaker setup information 28 from a wide variety of sources. As one example, a user/listener may manually enter the local loudspeaker setup information 28 via a user interface of the audio decoding unit 22. As another example, the loudspeaker position unit 612 may cause the plurality of local loudspeakers to emit various tones and utilize a microphone to determine the local loudspeaker setup information 28 based on the tones. As another example, the loudspeaker position unit 612 may receive images from one or more cameras, and perform image recognition to determine the local loudspeaker setup information 28 based on the images. The loudspeaker position unit 612 may provide representation 620 of the positions of the plurality of local loudspeakers to one or more other components of the rendering unit 210, such as rendering format unit 614. As another example, the local loudspeaker setup information 28 may be pre-programmed (e.g., at a factory) into audio decoding unit 22. For instance, where the loudspeakers 24 are integrated into a vehicle, the local loudspeaker setup information 28 may be pre-programmed into the audio decoding unit 22 by a manufacturer of the vehicle and/or an installer of loudspeakers 24.

The rendering format unit 614 may be configured to generate local rendering format 622 based on a representation of positions of a plurality of local loudspeakers (e.g., a local reproduction layout) and a position of a listener of the plurality of local loudspeakers. In some examples, the rendering format unit 614 may generate the local rendering format 622 such that, when the audio objects or HOA coefficients of renderer input 212 are rendered into loudspeaker feeds and played back through the plurality of local loudspeakers, the acoustic "sweet spot" is located at or near the position of the listener. In some examples, to generate the local rendering format 622, the rendering format unit 614 may generate a local rendering matrix D. The rendering format unit 614 may provide the local rendering format 622 to one or more other components of rendering unit 210, such as loudspeaker feed generation unit 616 and/or memory 615.

The memory 615 may be configured to store a local rendering format, such as the local rendering format 622. Where the local rendering format 622 comprises local rendering matrix $\tilde{D}$, the memory 615 may be configure to store local rendering matrix $\tilde{D}$.

The loudspeaker feed generation unit 616 may be configured to render audio objects or HOA coefficients into a plurality of output audio signals that each correspond to a respective local loudspeaker of the plurality of local loudspeakers. In the example of FIG. 8, the loudspeaker feed generation unit 616 may render the audio objects or HOA coefficients based on the local rendering format 622 such that when the resulting loudspeaker feeds 26 are played back through the plurality of local loudspeakers, the acoustic "sweet spot" is located at or near the position of the listener as determined by the listener location unit 610.

The audio decoding device 22, using various combinations of the components described in more detail above, represent an example of a device configured to store an audio object and audio object metadata associated with the audio object, where the audio object metadata includes frequency dependent beam pattern metadata. The device applies, based on the frequency dependent beam pattern metadata, a renderer to the audio object to obtain one or more first speaker feeds and obtains, based on the one or more speaker feeds, output speaker feeds. the frequency dependent beam pattern metadata is defined for a number of frequency bands. The frequency dependent beam pattern metadata may, for example, define a number of frequency bands. The number of frequency bands may, for example, be equal to M, with M being an integer value greater than 1. The device may render the M frequency bands using M different beam patterns in response to the number of frequency bands being equal to M.

The audio object metadata may, for example, include M sets of weighting values and at least M sets of metadata representative of M directional beams, with each of the M directional beams corresponding to one of the M frequency bands. The device may apply the M sets of weighting values to audio signals of the audio object to obtain weighted audio objects; sum the weighted audio objects to determine a weighted summation of audio objects; apply the renderer to the weighted summation of audio objects to obtain the one or more speaker feeds; and obtain, based on the one or more speaker feeds, the output speaker feeds Each of the M sets of metadata may include an azimuth value, an elevation value, a distance value, a gain value, and a diffuseness value. In some implementations, some of the metadata values, such as distance, gain, and diffuseness may be optional and not always included in the metadata.

Figure 9:
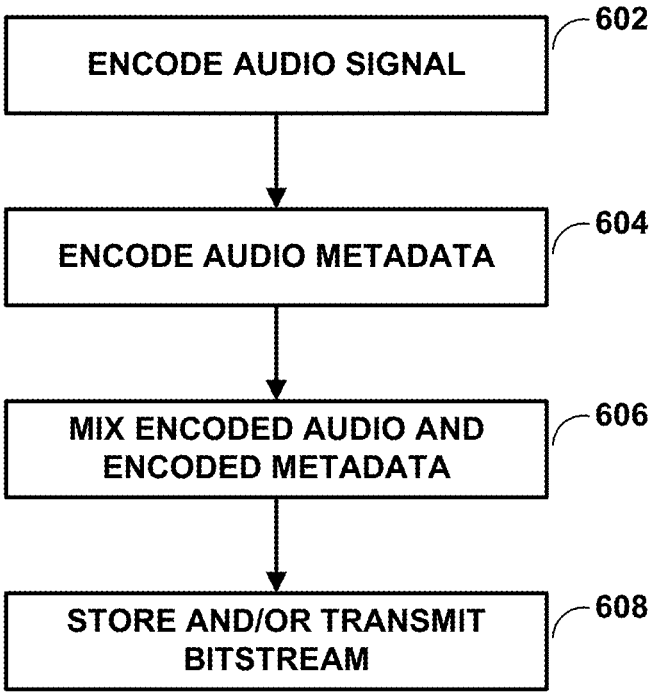
FIG. 9 is a flow diagram depicting a method of encoding audio data in accordance with one or more techniques of this disclosure.

FIG. 9 is a flow diagram depicting a method of encoding audio data according to the techniques of this disclosure. In some examples, the audio encoding unit 56 of the audio encoding device 14 may receive the audio signal 50A and encode the audio signal (602). The metadata encoding unit 48 of the audio encoding device 14 may receive the audio object metadata information 350 and may encode the audio metadata (604). The bit stream mixing unit 52 may then receive the encoded audio signal 50B and the encoded audio metadata 412 and mix the encoded audio signal 50B and the encoded audio metadata 412 to generate the bitstream 56 (606). The audio encoding device 14 may then store (e.g., in memory 54) and/or transmit the bitstream (608).

Figure 10:
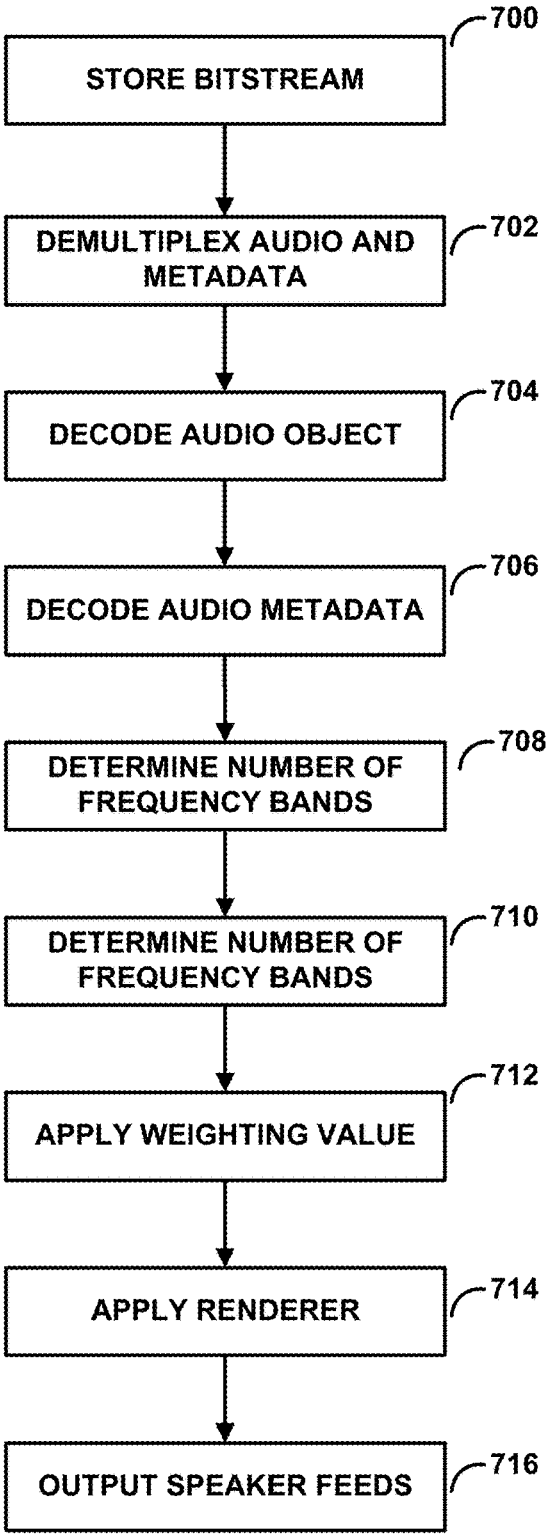
FIG. 10 is a flow diagram depicting a method of decoding audio data in accordance with one or more techniques of this disclosure.

FIG. 10 is a flow diagram depicting a method of decoding audio data according to the techniques of this disclosure. In some examples, audio decoding device may store the bitstream 56 containing encoded audio object(s) and audio metadata in memory 200 (700). The demultiplexing unit 202 may then demultiplex the encoded audio object(s) 62 and encoded audio metadata 71 (702). The audio decoding unit 204 may decode the encoded audio object(s) 62 (704). The metadata decoding unit may decode the encoded audio metadata 71 (706). The format generation unit 208 may generate a format (708) as discussed above. The rendering unit 210 may determine the number of frequency bands (710) for a given audio object. The rendering unit 210 may apply a weighting value (712). The rendering unit 210 may then apply the renderer (714) based on the number of frequency bands to obtain one or more speaker feeds. Audio decoding device 22 may then output the speaker feeds (716).

While these techniques are presented in a particular order, the techniques may not necessarily be performed in that order.

Figure 11:
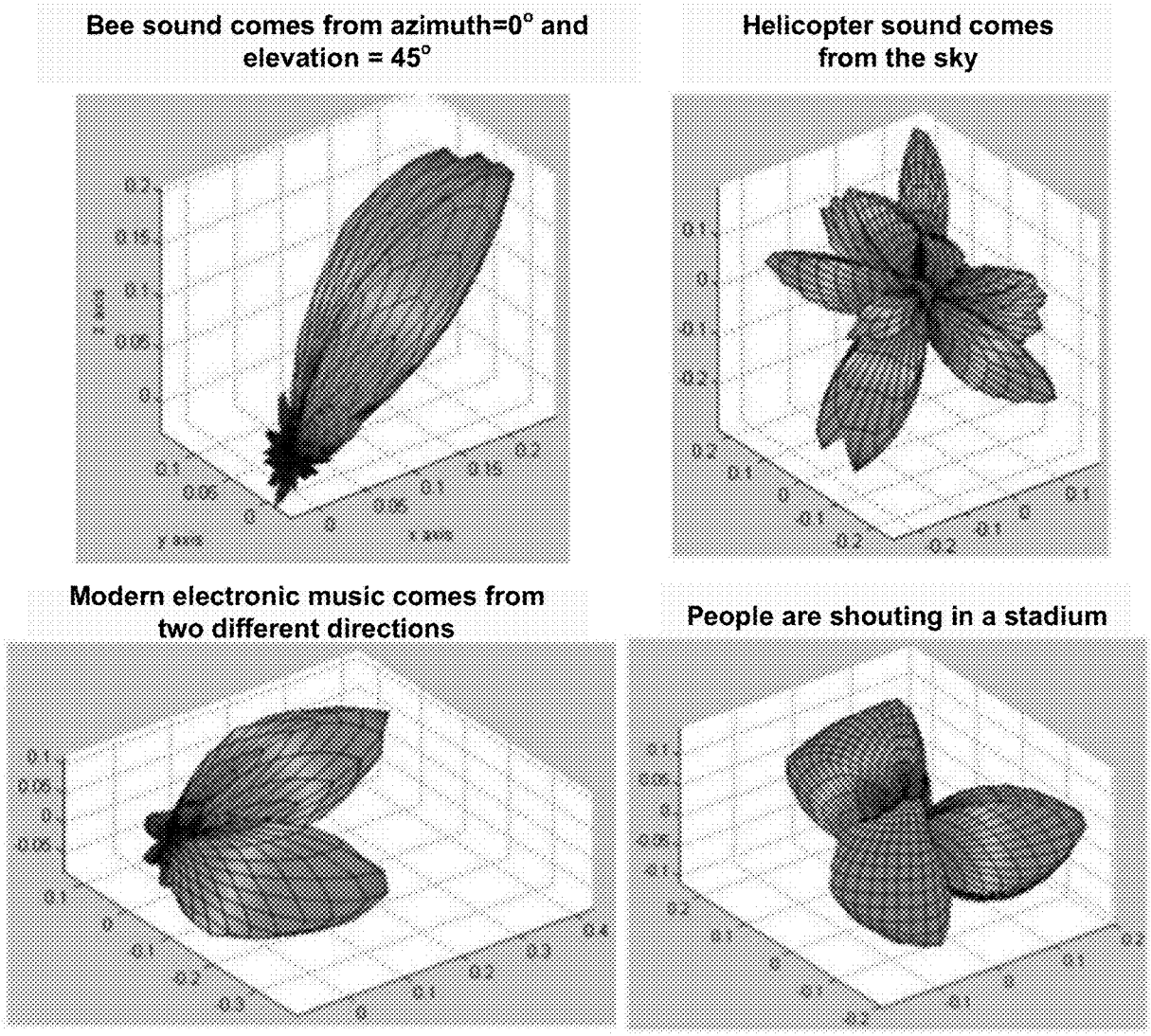
FIG. 11 shows examples of different types of beam patterns

FIG. 11 shows examples of different types of beam patterns. The audio decoding device 22 may generate such beam patterns based on scene-based audio.

Figure 12A:
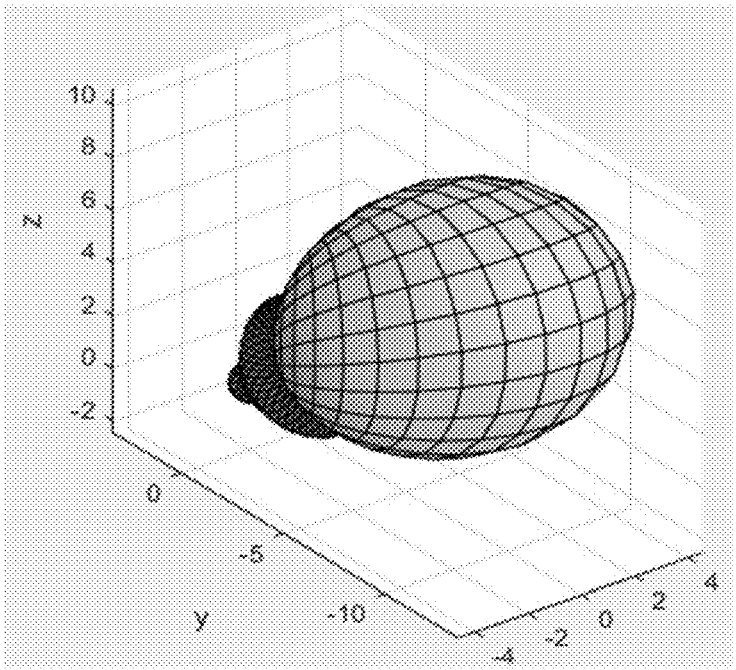
FIGS. 12A-12C shows examples of different types of beam patterns.
Figure 12B:
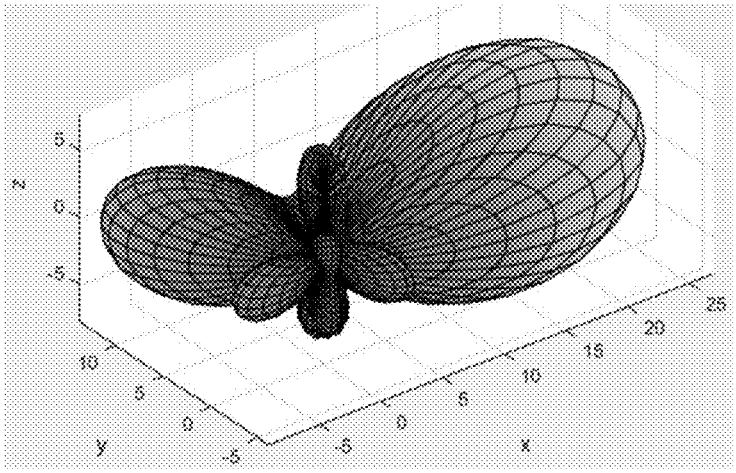
Figure 12C:
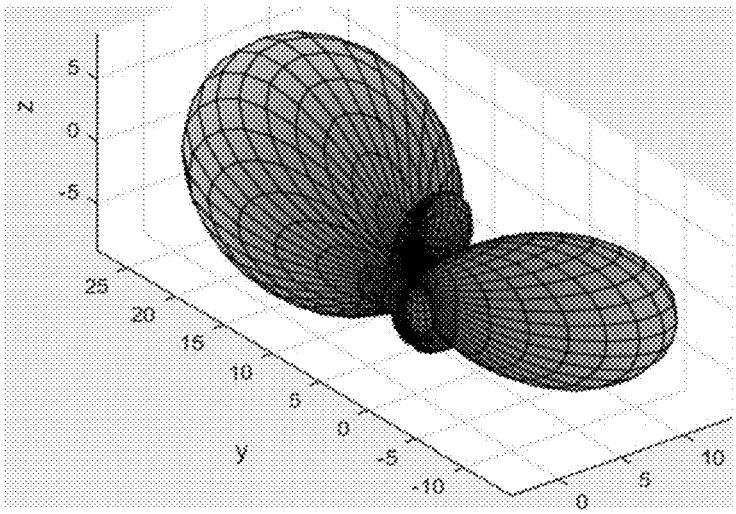

FIGS. 12A-12C shows examples of different types of beam patterns that may be generated using the techniques of this disclosure. The audio decoding device 22 may generate such beam patterns using object-based audio in accordance with the techniques of this disclosure. The audio decoding device 22 may use metadata for frequency dependent beam patterns to generate the beam patterns of FIGS. 10A-10C. For example, suppose object-based audio data includes M frequency bands. If M equals 1, then the audio decoding device 22 generates a beam pattern that is identical for entire frequency bands. If M is greater than 1, then the audio decoding device 22 generates beam patterns that are different for each frequency band. The bands may be divided where, FreqStartm represents a start frequency of an m-th band ($1 \le m \le M$), and FreqEnd_m represents an end frequency of an m-th band ($1 \le m \le M$). Table 1 shows an example of M frequency bands.

| Band index m | FreqStart_m | Freq End_m | Beam Pattern |
|---|---|---|---|
| 1 | 0 Hz | 100 Hz | $1^{st}$ beam pattern |
| 2 | 100 Hz | 200 Hz | $2^{nd}$ beam pattern |
| . . . | . . . | | |
| M | 12 Khz | 20 Khz | M-th Beam pattern |

FIG. 12A shows an example of a beam pattern for frequency band 1. FIG. 12B shows an example of a beam pattern for frequency band 2. FIG. 12C shows an example of a beam pattern for frequency band M.

Figure 13:
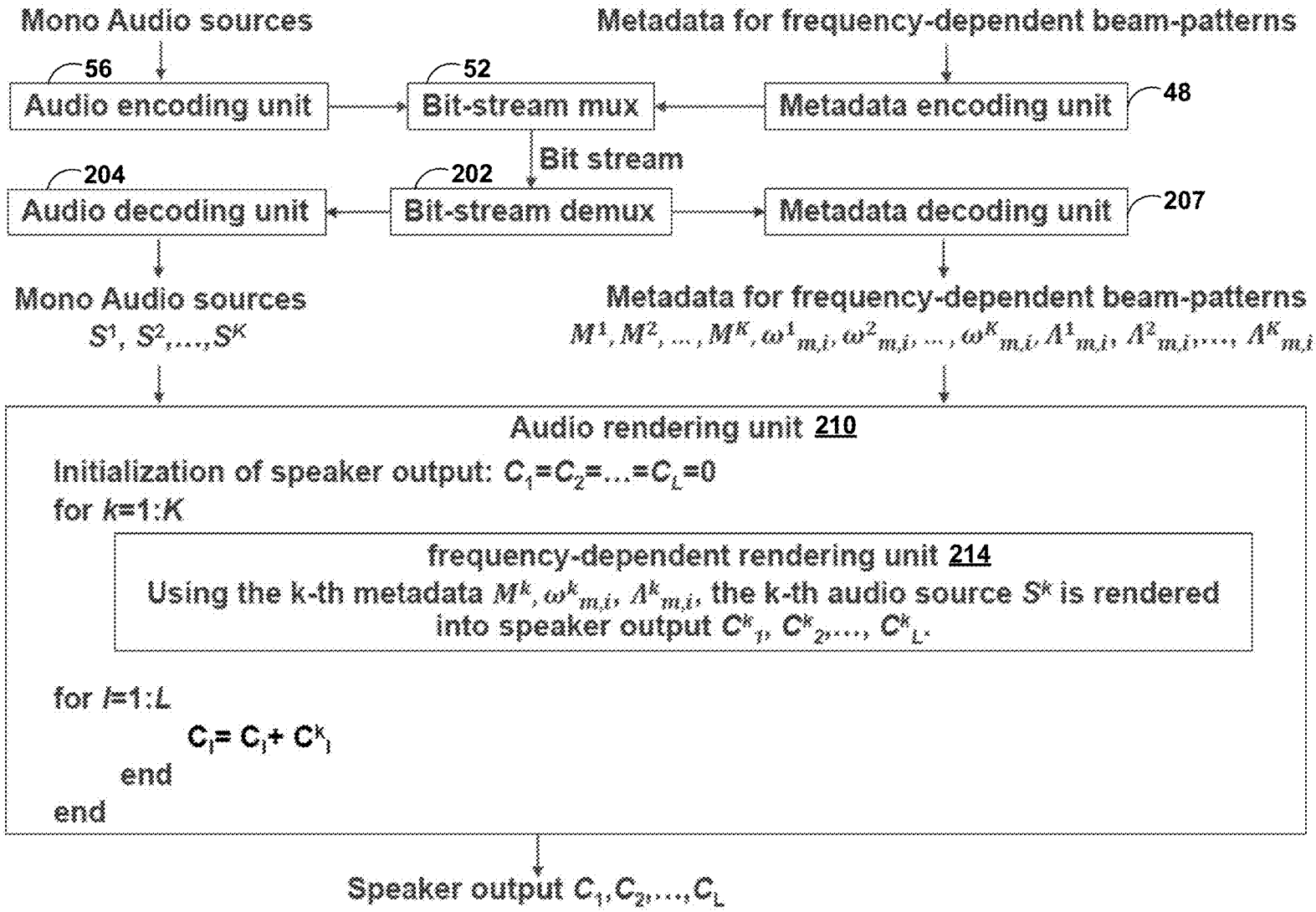
FIG. 13 shows an example of an audio encoding and decoding system configured to implement techniques described in this disclosure.

FIG. 13 shows an example of an audio encoding and decoding system configured to implement techniques described in this disclosure. Audio encoding unit 56, bitstream mixing unit 52, metadata encoding unit 48, metadata decoding unit 207, demultiplexing unit 202, and audio decoding unit 204 generally preform the same functions described above. Audio rendering unit 210 includes frequency-dependent rendering unit 214.

The audio encoding unit 56 encodes audio data from one or more mono audio sources. The audio decoding unit 204 decodes the encoded audio data to generate one or more decoded mono audio sources ($S^1$, $S^2$, . . . $S^K$). Metadata encoding unit 48 outputs metadata for frequency-dependent beam-patterns (e.g., M1, M2, . . . , MK, $\omega 1_{m,i}$, $\omega 2_{m,i}$, . . . , $\omega K_{m,i}$, $\Lambda 1_{m,i}$, $\Lambda 2_{m,i}$, . . . , $\Lambda K_{m,i}$).

The audio rendering unit 210 generates speaker outputs $C_1$ through $C_L$ according to the following process:

```
Initialization of speaker output: C1=C2= . . . =CL=0
for k=1:K
  Using the k-th metadata Mk, ωk_{m,i}, Λk_{m,i}, the k-th audio
  source S^k is rendered into speaker output C^k_1, C^k_2, . . . , C^kL.
  for l = 1:L
    Cl= C1+ C^k_1
  end
end
```

Figure 14:
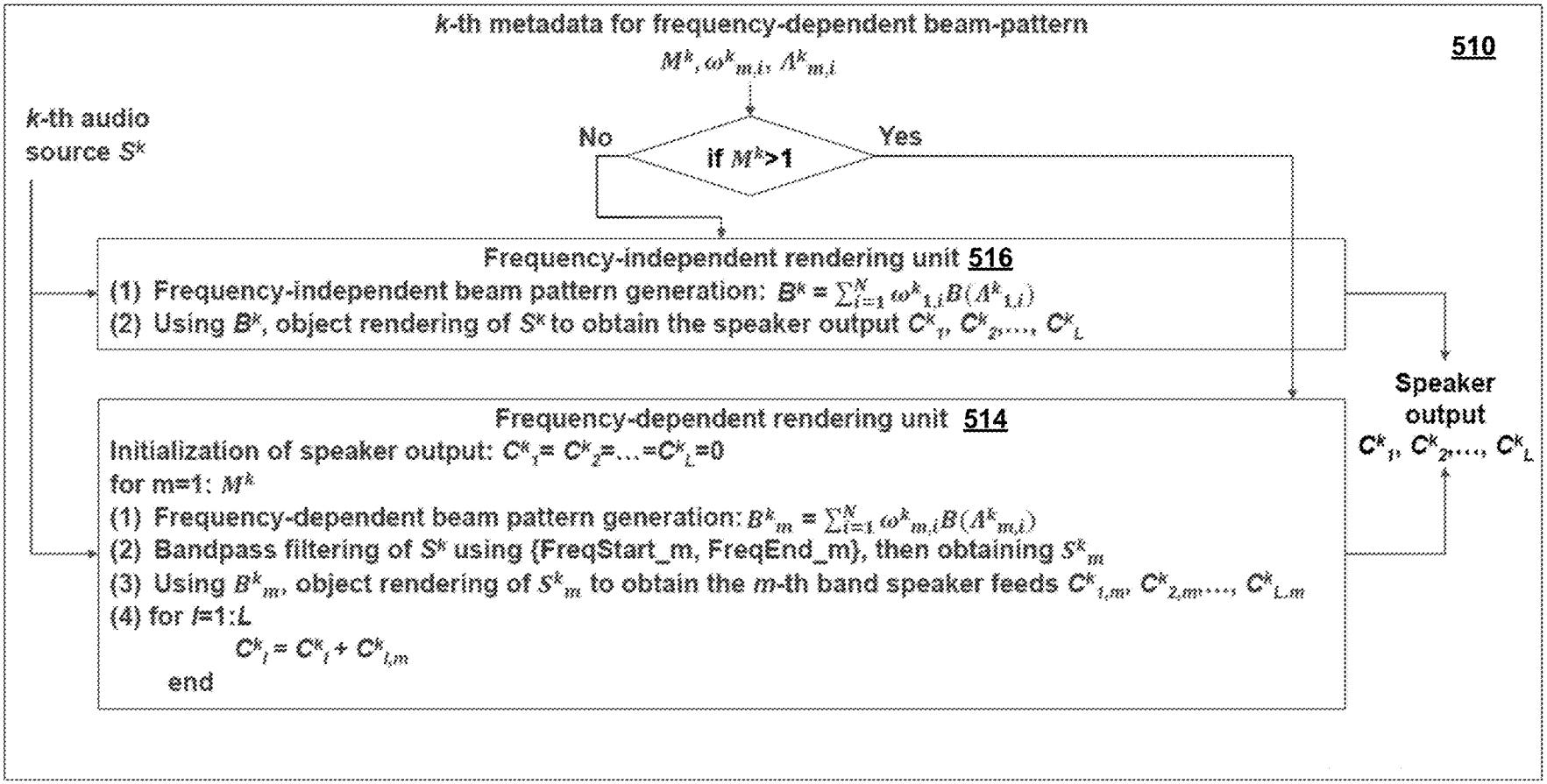
FIG. 14 shows an example of an audio decoding unit that is configured to render audio data in accordance with the techniques of this disclosure.

FIG. 14 shows an example implementation of the audio rendering unit 510. The audio rendering unit 510 generally corresponds to the render 210 but emphasizes different functionality. The audio rendering unit 510 includes frequency-independent rendering unit 516 and frequency-dependent rendering unit 514. The audio rendering unit 510 determines how many frequency dependent beam patterns are included in audio data. If the audio data includes one frequency dependent beam pattern, then the audio is rendered by the frequency-independent rendering unit 516, and if the audio data includes more than one frequency dependent beam pattern, then the audio is rendered by the frequency-dependent rendering unit 514.

The frequency-independent rendering unit 516 generates frequency-independent beam patterns according to $B^k=\Sigma_{i=1}^{N}\omega^k_{1,i}B(\Lambda^k_{1,i})$. Using $B^k$, frequency-independent rendering unit 516 performs object rendering of $S^k$ to obtain the speaker output $C^k_1$, $C^k_2$, . . . , $C^k_L$.

The frequency-dependent rendering unit 514 initializes speaker outputs $C^k_1=C^k_2= \ldots =C^k_L=0$. For m equals 1 to $M^k$, the frequency-dependent rendering unit 514 generates frequency-dependent beam patterns according to $B^k_m=\Sigma_{i=1}^{N}\omega^k_{m,i}B(\Lambda^k_{m,i})$. The frequency-dependent rendering unit 514 performs bandpass filtering of $S^k$ using {FreqStart_m, FreqEnd_m} and then obtains $S^k_m$. Using $B^k_m$, frequency-dependent rendering unit 514 performs object rendering of $S^k_m$ to obtain the m-th band speaker feeds $C^k_{1,m}$, $C^k_{2,m}$, . . . $C^k_{L.m}$, where:

```
for l=1:L
  C^k_l = C^k_l + C^k_{l,m}
end
```

Various aspects of the techniques of this disclosure may enable one or more of the devices described above to perform the examples listed below.

Example 1

A device configured for processing coded audio, the device comprising: a memory configured to store an audio object and audio object metadata associated with the audio object, wherein the audio object meta data comprises frequency dependent beam pattern metadata, one or more processors electronically coupled to the memory, the one or more processors configured to: apply, based on the frequency dependent beam pattern metadata, a renderer to the audio object to obtain one or more first speaker feeds; and output the one or more speaker feeds.

Example 2

The device of example 1, wherein the frequency dependent beam pattern metadata is defined for a number of frequency bands.

Example 3

The device of example 2, wherein the number of frequency bands is equal to 1.

Example 4

The device of example 3, wherein the one or more processors are configured to render all frequencies of the audio object using a same beam pattern in response to the number of frequency bands being equal to 1.

Example 5

The device of any of examples 1-4, wherein: the audio object metadata further comprises a first set of weighting values and at least a first set of metadata representative of a first directional beam for the audio object; and the one or more processors are further configured to: apply the first set of weighting values to the audio object to obtain a weighted audio object; and apply, based on the first set of metadata representative of the first directional beam, the renderer to the weighted audio object to obtain the one or more first speaker feeds.

Example 6

The device of example 5, wherein the first set of metadata to describe the first directional beam for the audio object comprises an azimuth value.

Example 7

The device of example 5 or 6, wherein the first set of metadata to describe the first directional beam for the audio object comprises an elevation value.

Example 8

The device of any of example 5-7, wherein the first set of metadata to describe the first directional beam for the audio object comprises a distance value.

Example 9

The device of any of examples 5-8, wherein the first set of metadata to describe the first directional beam for the audio object comprises a gain value.

Example 10

The device of any of examples 5-9, wherein the first set of metadata to describe the first directional beam for the audio object comprises a diffuseness value.

Example 11

The device of any of examples 1, 2, or 5-10, wherein the number of frequency bands is greater than 1.

Example 12

The device of example 11, wherein the one or more processors are configured to render a first frequency band of the audio object using a first beam pattern and render a second frequency band of the audio object using a second beam pattern in response to the number of frequency bands being greater than 1.

Example 13

The device of any of examples 1, 2, or 5-12, wherein:

the audio object metadata further comprises a first set of weighting values and at least a first set of metadata representative of a first directional beam for the first frequency band of the audio object and a second set of weighting values and at least a second set of metadata representative of a second directional beam for the second frequency band of the audio object; and the one or more processors are further configured to: apply the first set of weighting values to audio signals of the audio object within the first frequency band to obtain a first weighted audio object; apply the second set of weighting values to audio signals of the audio object within the second frequency band to obtain a second weighted audio object; sum the first weighted audio object and the second weighted audio object to determine a weighted summation of audio objects; and apply the renderer to the weighted summation of audio objects to obtain the one or more speaker feeds.

Example 14

The device of example 13, wherein the first set of metadata to describe the first directional beam for the audio object comprises a first azimuth value and the second set of metadata to describe the second directional beam for the audio object comprises a second azimuth value.

Example 15

The device of example 13 or 14, wherein the first set of metadata to describe the first directional beam for the audio object comprises a first elevation value and the second set of metadata to describe the second directional beam for the audio object comprises a second elevation value.

Example 16

The device of any of examples 13-15, wherein the first set of metadata to describe the first directional beam for the audio object comprises a first distance value and the second set of metadata to describe the second directional beam for the audio object comprises a second distance value.

Example 17

The device of any of examples 13-16, wherein the first set of metadata to describe the first directional beam for the audio object comprises a first gain value and the second set of metadata to describe the second directional beam for the audio object comprises a second gain value.

Example 18

The device of any of examples 13-17, wherein the first set of metadata to describe the first directional beam for the audio object comprises a first diffuseness value and the second set of metadata to describe the second directional beam for the audio object comprises a second diffuseness value.

Example 19

The device of any of examples 1, 2, or 5-18 wherein the number of frequency bands is equal to M, M being an integer value greater than 1.

Example 20

The device of example 19, wherein the one or more processors are configured to render the M frequency bands using M different beam patterns in response to the number of frequency bands being equal to M.

Example 21

The device of example 19 or 20, wherein: the audio object metadata further comprises M sets of weighting values and at least M sets of metadata representative of M directional beams, each of the M directional beams corresponding to one of the M frequency bands; and the one or more processors are further configured to: apply the M sets of weighting values to audio signals of the audio object to obtain weighted audio objects; sum the weighted audio objects to determine a weighted summation of audio objects; and apply the renderer to the weighted summation of audio objects to obtain the one or more speaker feeds.

Example 22

The device of example 21, wherein each of the M sets of metadata comprises an azimuth value.

Example 23

The device of example 21 or 22, wherein each of the M sets of metadata comprises an elevation value.

Example 24

The device of any of examples 21-23, wherein each of the M sets of metadata comprises a distance value.

Example 25

The device of any of examples 21-24, wherein each of the M sets of metadata comprises a gain value.

Example 26

The device of any of examples 21-25, wherein each of the M sets of metadata comprises a diffuseness value.

Example 27

The device of any of examples 1-26, wherein to apply the renderer, the one or more processors are configured to perform vector-based amplitude panning with respect to the weighted audio object.

Example 28

The device of any of examples 1-27, further comprising: one or more speakers configured to reproduce, based on the output speaker feeds, a soundfield.

Example 29

The device of any of examples 1-28, wherein the device comprises a vehicle.

Example 30

The device of any of examples 1-29, wherein the device comprises an unmanned vehicle.

Example 31

The device of any of examples 1-30, wherein the device comprises a robot.

Example 32

The device of any of examples 1-28, wherein the device comprises a handset.

Example 33

The device of any of examples 1-32, wherein the one or more processors comprise processing circuitry.

Example 34

The device of example 33, wherein the processing circuitry comprises one or more application specific integrated circuits.

Example 35

A method for processing coded audio, the method comprising: storing an audio object and audio object metadata associated with the audio object, wherein the audio object meta data comprises frequency dependent beam pattern metadata; applying, based on the frequency dependent beam pattern metadata, a renderer to the audio object to obtain one or more first speaker feeds; and outputting the one or more speaker feeds.

Example 36

The method of example 35, wherein the frequency dependent beam pattern metadata is defined for a number of frequency bands.

Example 37

The method of example 36, wherein the number of frequency bands is equal to 1.

Example 38

The method of example 37, further comprising: rendering all frequencies of the audio object using a same beam pattern in response to the number of frequency bands being equal to 1.

Example 39

The method of any of examples 35-38, wherein the audio object metadata further comprises a first set of weighting values and at least a first set of metadata representative of a first directional beam for the audio object, wherein the method further comprises: applying the first set of weighting values to the audio object to obtain a weighted audio object; and applying, based on the first set of metadata representative of the first directional beam, the renderer to the weighted audio object to obtain the one or more first speaker feeds.

Example 40

The method of example 39, wherein the first set of metadata to describe the first directional beam for the audio object comprises an azimuth value.

Example 41

The method of example 39 or 40, wherein the first set of metadata to describe the first directional beam for the audio object comprises an elevation value.

Example 42

The method of any of examples 39-41, wherein the first set of metadata to describe the first directional beam for the audio object comprises a distance value.

Example 43

The method of any of examples 39-42, wherein the first set of metadata to describe the first directional beam for the audio object comprises a gain value.

Example 44

The method of any of examples 39-43, wherein the first set of metadata to describe the first directional beam for the audio object comprises a diffuseness value.

Example 45

The method of any of examples 35, 36, or 39-45, wherein the number of frequency bands is greater than 1.

Example 46

The method of example 45, further comprising: rendering a first frequency band of the audio object using a first beam pattern and render a second frequency band of the audio object using a second beam pattern in response to the number of frequency bands being greater than 1.

Example 47

The method of any of examples 35, 36, or 39-46 wherein the audio object metadata further comprises a first set of weighting values and at least a first set of metadata representative of a first directional beam for the first frequency band of the audio object and a second set of weighting values and at least a second set of metadata representative of a second directional beam for the second frequency band of the audio object, the method further comprising: applying the first set of weighting values to audio signals of the audio object within the first frequency band to obtain a first weighted audio object; applying the second set of weighting values to audio signals of the audio object within the second frequency band to obtain a second weighted audio object; summing the first weighted audio object and the second weighted audio object to determine a weighted summation of audio objects; and applying the renderer to the weighted summation of audio objects to obtain the one or more speaker feeds.

Example 48

The method of example 47, wherein the first set of metadata to describe the first directional beam for the audio object comprises a first azimuth value and the second set of metadata to describe the second directional beam for the audio object comprises a second azimuth value.

Example 49

The method of example 47 or 48, wherein the first set of metadata to describe the first directional beam for the audio object comprises a first elevation value and the second set of metadata to describe the second directional beam for the audio object comprises a second elevation value.

Example 50

The method of any of examples 47-49, wherein the first set of metadata to describe the first directional beam for the audio object comprises a first distance value and the second set of metadata to describe the second directional beam for the audio object comprises a second distance value.

Example 51

The method of any of examples 47-50, wherein the first set of metadata to describe the first directional beam for the audio object comprises a first gain value and the second set of metadata to describe the second directional beam for the audio object comprises a second gain value.

Example 52

The method of any of examples 47-51, wherein the first set of metadata to describe the first directional beam for the audio object comprises a first diffuseness value and the second set of metadata to describe the second directional beam for the audio object comprises a second diffuseness value.

Example 53

The method of any of examples 34, 35, 38-52, wherein the number of frequency bands is equal to M, M being an integer value greater than 1.

Example 54

The method of example 53, the method further comprising:

rendering the M frequency bands using M different beam patterns in response to the number of frequency bands being equal to M.

Example 55

The method of example 53 or 54, wherein the audio object metadata further comprises M sets of weighting values and at least M sets of metadata representative of M directional beams, each of the M directional beams corresponding to one of the M frequency bands, the method further comprising: applying the M sets of weighting values to audio signals of the audio object to obtain weighted audio objects; summing the weighted audio objects to determine a weighted summation of audio objects; and applying the renderer to the weighted summation of audio objects to obtain the one or more speaker feeds.

Example 56

The method of example 55, wherein each of the M sets of metadata comprises an azimuth value.

Example 57

The method of example 55 or 56, wherein each of the M sets of metadata comprises an elevation value.

Example 58

The method of any of examples 55-57, wherein each of the M sets of metadata comprises a distance value.

Example 59

The method of any of examples 55-58, wherein each of the M sets of metadata comprises a gain value.

Example 60

The method of any of examples 55-59, wherein each of the M sets of metadata comprises a diffuseness value.

Example 61

The method of any of examples 35-60, wherein applying the renderer comprises performing vector-based amplitude panning with respect to the weighted audio object.

Example 62

The method of any of examples 35-61, further comprising: reproducing, based on the output speaker feeds, a soundfield using one or more speakers.

Example 63

The method of any of examples 35-62, wherein the method is performed by a vehicle.

Example 64

The method of any of examples 35-63, wherein the method is performed by an unmanned vehicle.

Example 65

The method of any of examples 35-64, wherein the method is performed by a robot.

Example 66

The method of any of examples 35-62, wherein the method is performed by a handset.

Example 67

The method of any of examples 35-66, wherein the method is performed by one or more processors comprise processing circuitry.

Example 68

The method of example 67, wherein the processing circuitry comprises one or more application specific integrated circuits.

Example 69

A computer-readable storage medium storing instructions that when executed by one or more processors cause the one or more processors to perform the method of any of examples 35-68.

Example 70

An apparatus for processing coded audio, the apparatus comprising: means for storing an audio object and audio object metadata associated with the audio object, wherein the audio object meta data comprises frequency dependent beam pattern metadata; means for applying, based on the frequency dependent beam pattern metadata, a renderer to the audio object to obtain one or more first speaker feeds; and means for outputting the one or more speaker feeds.

Example 71

The apparatus of example 70, wherein the frequency dependent beam pattern metadata is defined for a number of frequency bands.

Example 72

The apparatus of example 71, wherein the number of frequency bands is equal to 1.

Example 73

The apparatus of example 72, further comprising: means for rendering all frequencies of the audio object using a same beam pattern in response to the number of frequency bands being equal to 1.

Example 74

The apparatus of any of examples 70-73, wherein the audio object metadata further comprises a first set of weighting values and at least a first set of metadata representative of a first directional beam for the audio object, the apparatus further comprising: means for applying the first set of weighting values to the audio object to obtain a weighted audio object; and means for applying, based on the first set of metadata representative of the first directional beam, the renderer to the weighted audio object to obtain the one or more first speaker feeds.

Example 75

The apparatus of example 74, wherein the first set of metadata to describe the first directional beam for the audio object comprises an azimuth value.

Example 76

The apparatus of example 74 or 75, wherein the first set of metadata to describe the first directional beam for the audio object comprises an elevation value.

Example 77

The apparatus of any of examples 74-76, wherein the first set of metadata to describe the first directional beam for the audio object comprises a distance value.

Example 78

The apparatus of any of examples 74-77, wherein the first set of metadata to describe the first directional beam for the audio object comprises a gain value.

Example 79

The apparatus of any of examples 74-78, wherein the first set of metadata to describe the first directional beam for the audio object comprises a diffuseness value.

Example 80

The apparatus of any of examples 70, 71, or 74-79, wherein the number of frequency bands is greater than 1.

Example 81

The apparatus of example 80, further comprising: means for rendering a first frequency band of the audio object using a first beam pattern and render a second frequency band of the audio object using a second beam pattern in response to the number of frequency bands being greater than 1.

Example 82

The apparatus of any of examples 70, 71, or 74-81 wherein the audio object metadata further comprises a first set of weighting values and at least a first set of metadata representative of a first directional beam for the first frequency band of the audio object and a second set of weighting values and at least a second set of metadata representative of a second directional beam for the second frequency band of the audio object, the apparatus further comprising: means for applying the first set of weighting values to audio signals of the audio object within the first frequency band to obtain a first weighted audio object; means for applying the second set of weighting values to audio signals of the audio object within the second frequency band to obtain a second weighted audio object; means for summing the first weighted audio object and the second weighted audio object to determine a weighted summation of audio objects; and means for applying the renderer to the weighted summation of audio objects to obtain the one or more speaker feeds.

Example 83

The apparatus of example 82, wherein the first set of metadata to describe the first directional beam for the audio object comprises a first azimuth value and the second set of metadata to describe the second directional beam for the audio object comprises a second azimuth value.

Example 84

The apparatus of example 82 or 83, wherein the first set of metadata to describe the first directional beam for the audio object comprises a first elevation value and the second set of metadata to describe the second directional beam for the audio object comprises a second elevation value.

Example 85

The apparatus of any of examples 82-84, wherein the first set of metadata to describe the first directional beam for the audio object comprises a first distance value and the second set of metadata to describe the second directional beam for the audio object comprises a second distance value.

Example 86

The apparatus of any of examples 82-85, wherein the first set of metadata to describe the first directional beam for the audio object comprises a first gain value and the second set of metadata to describe the second directional beam for the audio object comprises a second gain value.

Example 87

The apparatus of any of examples 82-86, wherein the first set of metadata to describe the first directional beam for the audio object comprises a first diffuseness value and the second set of metadata to describe the second directional beam for the audio object comprises a second diffuseness value.

Example 88

The apparatus of any of examples 69, 70, 73-87, wherein the number of frequency bands is equal to M, M being an integer value greater than 1.

Example 89

The apparatus of example 88, the apparatus further comprising: means for rendering the M frequency bands using M different beam patterns in response to the number of frequency bands being equal to M.

Example 90

The apparatus of example 88 or 89, wherein the audio object metadata further comprises M sets of weighting values and at least M sets of metadata representative of M directional beams, each of the M directional beams corresponding to one of the M frequency bands, the apparatus further comprising: means for applying the M sets of weighting values to audio signals of the audio object to obtain weighted audio objects; means for summing the weighted audio objects to determine a weighted summation of audio objects; and means for applying the renderer to the weighted summation of audio objects to obtain the one or more speaker feeds.

Example 91

The apparatus of example 90, wherein each of the M sets of metadata comprises an azimuth value.

Example 92

The apparatus of example 90 or 91, wherein each of the M sets of metadata comprises an elevation value.

Example 93

The apparatus of any of examples 90-92, wherein each of the M sets of metadata comprises a distance value.

Example 94

The apparatus of any of examples 90-93, wherein each of the M sets of metadata comprises a gain value.

Example 95

The apparatus of any of examples 90-94, wherein each of the M sets of metadata comprises a diffuseness value.

Example 96

The apparatus of any of examples 70-95, wherein the means for applying the renderer comprises means for performing vector-based amplitude panning with respect to the weighted audio object.

Example 97

The apparatus of any of examples 70-96, further comprising: means for reproducing, based on the output speaker feeds, a soundfield using one or more speakers.

Example 98

The apparatus of any of examples 70-97, wherein the apparatus comprises a vehicle.

Example 99

The apparatus of any of examples 70-98, wherein the apparatus comprises an unmanned vehicle.

Example 100

The apparatus of any of examples 70-99, wherein the apparatus comprises a robot.

Example 101

The apparatus of any of examples 70-97, wherein the apparatus comprises a handset.

Example 102

The apparatus of any of examples 70-101, wherein the apparatus comprises one or more processors comprise processing circuitry.

Example 103

The apparatus of example 102, wherein the processing circuitry comprises one or more application specific integrated circuits.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code, and/or data structures for implementation of the techniques described in this disclosure. A computer program product may include a computer-readable medium.

Likewise, in each of the various instances described above, it should be understood that the audio decoding device 22 may perform a method or otherwise comprise means to perform each step of the method for which the audio decoding device 22 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A device configured for processing coded audio, the device comprising:

a memory configured to store an audio object and audio object metadata associated with the audio object, wherein the audio object meta data comprises frequency dependent beam pattern metadata and the frequency dependent beam pattern metadata comprises a syntax element indicative of whether the device change a beam pattern based on frequency, and one or more processors electronically coupled to the memory, the one or more processors are configured to:

determine a value of the syntax element;

apply, based on the value of the syntax element indicating to change the beam pattern based on frequency, a renderer to the audio object to obtain one or more speaker feeds; and output the one or more speaker feeds, wherein the renderer changes the beam pattern based on frequency.

2. The device of claim 1, wherein the frequency dependent beam pattern metadata is defined for a number of frequency bands being equal to or greater than 1.

3. The device of claim 2, wherein the one or more processors are configured to render all frequencies of the audio object using a same beam pattern in response to the number of frequency bands being equal to 1.

4. The device of claim 1, wherein:

the audio object metadata further comprises a first set of weighting values and at least a first set of metadata representative of a first directional beam for the audio object; and the one or more processors are further configured to:

apply the first set of weighting values to the audio object to obtain a weighted audio object; and apply, based on the first set of metadata representative of the first directional beam, the renderer to the weighted audio object to obtain the one or more speaker feeds.

5. The device of claim 4, wherein the first set of metadata to describe the first directional beam for the audio object comprises at least one of an azimuth value, an elevation value, a distance value, a gain value or a diffuseness value.

6. The device of claim 2, wherein:

the number of frequency bands is equal to M, M being an integer value greater than 1;

the audio object metadata further comprises M sets of weighting values and at least M sets of metadata representative of M directional beams, each of the M directional beams corresponding to one of the M frequency bands; and the one or more processors are further configured to:

apply the M sets of weighting values to audio signals of the audio object to obtain weighted audio objects;

sum the weighted audio objects to determine a weighted summation of audio objects; and apply the renderer to the weighted summation of audio objects to obtain the one or more speaker feeds.

7. The device of claim 6, wherein each of the M sets of metadata comprises at least one of an azimuth value, an elevation value, a distance value, a gain value or a diffuseness value.

8. The device of claim 6, wherein to apply the renderer, the one or more processors are configured to perform vector-based amplitude panning with respect to the weighted audio object.

9. The device of claim 1, further comprising:

one or more speakers configured to reproduce, based on the output speaker feeds, a soundfield.

10. The device of claim 1, wherein the device comprises one of a vehicle, an unmanned vehicle, a robot, and a handset.

11. The device of claim 1, wherein the one or more processors comprises one or more integrated circuits.

12. A method for processing coded audio, the method comprising:

storing an audio object and audio object metadata associated with the audio object, wherein the audio object meta data comprises frequency dependent beam pattern metadata and the frequency dependent beam pattern metadata comprises a syntax element indicative of whether the device change a beam pattern based on frequency;

determining a value of the syntax element;

applying, based on the value of the syntax element indicating to change the beam pattern based on frequency, a renderer to the audio object to obtain one or more speaker feeds; and output the one or more speaker feeds, wherein the renderer changes the beam pattern based on frequency.

13. The method of claim 12, wherein the frequency dependent beam pattern metadata is defined for a number of frequency bands being equal to or greater than 1.

14. The method of claim 13, further comprising:

rendering all frequencies of the audio object using a same beam pattern in response to the number of frequency bands being equal to 1.

15. The method of claim 12, wherein the audio object metadata further comprises a first set of weighting values and at least a first set of metadata representative of a first directional beam for the audio object, wherein the method further comprises:

applying the first set of weighting values to the audio object to obtain a weighted audio object; and applying, based on the first set of metadata representative of the first directional beam, the renderer to the weighted audio object to obtain the one or more first speaker feeds.

16. The method of claim 15, wherein the first set of metadata to describe the first directional beam for the audio object comprises at least one of an azimuth value, an elevation value, a distance value, a gain value, and a diffuseness value.

17. The method of claim 13, wherein the number of frequency bands is equal to M, M being an integer value greater than 1, the audio object metadata further comprises M sets of weighting values and at least M sets of metadata representative of M directional beams, each of the M directional beams corresponding to one of the M frequency bands, the method further comprising:

applying the M sets of weighting values to audio signals of the audio object to obtain weighted audio objects;

summing the weighted audio objects to determine a weighted summation of audio objects; and applying the renderer to the weighted summation of audio objects to obtain the one or more speaker feeds.

18. The method of claim 17, wherein each of the M sets of metadata comprises at least one of an azimuth value, an elevation value, a distance value, a gain value, and a diffuseness value.

19. The method of claim 17, wherein applying the renderer comprises performing vector-based amplitude panning with respect to the weighted audio object.

20. The method of claim 12, further comprising:

reproducing, based on the output speaker feeds, a soundfield using one or more speakers.

21. The method of claim 12, wherein the method is performed by one of a vehicle, an unmanned vehicle, a robot, or a handset.

22. The method of claim 12, wherein the method is performed by one or more integrated circuits.

23. An apparatus for processing coded audio, the apparatus comprising:

means for storing an audio object and audio object metadata associated with the audio object, wherein the audio object meta data comprises frequency dependent beam pattern metadata and the frequency dependent beam pattern metadata comprises a syntax element indicative of whether the device change a beam pattern based on frequency;

means for determining a value of the syntax element;

means for applying, based on the value of the syntax element indicating to change the beam pattern based on frequency, a renderer to the audio object to obtain one or more speaker feeds; and means for outputting the one or more speaker feeds, wherein the renderer changes the beam pattern based on frequency.

24. The apparatus of claim 23, wherein the frequency dependent beam pattern metadata is defined for a number of frequency bands being greater or equal to 1.

25. The apparatus of claim 23, further comprising:

means for rendering all frequencies of the audio object using a same beam pattern in response to the number of frequency bands being equal to 1.

26. The apparatus of claim 23, wherein the audio object metadata further comprises a first set of weighting values and at least a first set of metadata representative of a first directional beam for the audio object, the apparatus further comprising:

means for applying the first set of weighting values to the audio object to obtain a weighted audio object; and means for applying, based on the first set of metadata representative of the first directional beam, the renderer to the weighted audio object to obtain the one or more first speaker feeds.

27. The apparatus of claim 24, wherein the number of frequency bands is equal to M, M being an integer value greater than 1, the audio object metadata further comprises M sets of weighting values and at least M sets of metadata representative of M directional beams, each of the M directional beams corresponding to one of the M frequency bands, the apparatus further comprising:

means for applying the M sets of weighting values to audio signals of the audio object to obtain weighted audio objects;

means for summing the weighted audio objects to determine a weighted summation of audio objects; and means for applying the renderer to the weighted summation of audio objects to obtain the one or more speaker feeds.

28. The apparatus of claim 23, wherein the apparatus comprises one of a vehicle, an unmanned vehicle, a robot or a handset.

29. The apparatus of claim 23, wherein the apparatus comprises one or more integrated circuits.

30. A non-transitory computer readable storage medium containing instructions that when executed by one or more processors cause the one or more processors to:

store an audio object and audio object metadata associated with the audio object, wherein the audio object meta data comprises frequency dependent beam pattern metadata and the frequency dependent beam pattern metadata comprises a syntax element indicative of whether the device change a beam pattern based on frequency;

determine a value of the syntax element;

apply, based on the value of the syntax element indicating to change the beam pattern based on frequency, a renderer to the audio object to obtain one or more first speaker feeds; and output the one or more speaker feeds, wherein the renderer changes the beam pattern based on frequency.

* * * * *